US009761177B2

(12) United States Patent
Mizukoshi

(10) Patent No.: US 9,761,177 B2
(45) Date of Patent: Sep. 12, 2017

(54) ORGANIC LIGHT EMITTING DISPLAY DEVICE

(71) Applicant: LG DISPLAY CO., LTD., Seoul (KR)

(72) Inventor: Seiichi Mizukoshi, Chigasaki-shi (JP)

(73) Assignee: LG DISPLAY CO., LTD., Seoul (KR)

( * ) Notice: Subject to any disclaimer, the term of this patent is extended or adjusted under 35 U.S.C. 154(b) by 222 days.

(21) Appl. No.: 14/562,146

(22) Filed: Dec. 5, 2014

(65) Prior Publication Data

US 2015/0179105 A1 Jun. 25, 2015

(30) Foreign Application Priority Data

Dec. 24, 2013 (KR) ..... 10-2013-0162652

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/043* (2013.01); *G09G 2300/0465* (2013.01); *G09G 2300/0842* (2013.01); *G09G 2310/0262* (2013.01); *G09G 2320/0233* (2013.01); *G09G 2320/0295* (2013.01); *G09G 2320/043* (2013.01); *G09G 2320/045* (2013.01)

(58) Field of Classification Search
USPC ..... 345/76
See application file for complete search history.

(56) References Cited

U.S. PATENT DOCUMENTS

| | | | |
|---|---|---|---|
| 7,982,695 | B2 | 7/2011 | Mizukoshi et al. |
| 2009/0140959 | A1 | 6/2009 | Nam et al. |
| 2010/0013806 | A1 | 1/2010 | Yoo et al. |
| 2010/0109540 | A1 | 5/2010 | Kim et al. |
| 2011/0227505 | A1 | 9/2011 | Park et al. |
| 2011/0316892 | A1 | 12/2011 | Sung et al. |
| 2013/0147690 | A1 | 6/2013 | Kim et al. |
| 2013/0162617 | A1 | 6/2013 | Yoon et al. |
| 2013/0257831 | A1 | 10/2013 | Kim et al. |
| 2014/0022289 | A1 | 1/2014 | Lee et al. |

FOREIGN PATENT DOCUMENTS

| | | | |
|---|---|---|---|
| CN | 101727826 | A | 6/2010 |
| CN | 103177685 | A | 6/2013 |
| CN | 103366676 | A | 10/2013 |
| KR | 10-2012-0076215 | A | 7/2012 |

*Primary Examiner* — Gustavo Polo
(74) *Attorney, Agent, or Firm* — Birch, Stewart, Kolasch & Birch, LLP

(57) ABSTRACT

An organic light emitting display device including a display panel including a first pixel connected with a first data line and first and second scan lines, a second pixel connected with a second data line and the first and second scan lines, and a reference line connected in common with the first and second pixels; a source driver configured to operate first and second sensing modes for sensing driving characteristic values of the first and second pixels through the reference line; and a scan driver configured to drive the first and second scan lines so as to drive only the first pixel for the first sensing mode or only the second pixel for the second sensing mode.

21 Claims, 14 Drawing Sheets

ORGANIC LIGHT EMITTING DISPLAY DEVICE

CROSS REFERENCE TO RELATED APPLICATIONS

This application claims the benefit of the Korean Patent Application No. 10-2013-0162652 filed on Dec. 24, 2013, which is hereby incorporated by reference as if fully set forth herein.

BACKGROUND OF THE INVENTION

Field of the Invention

Embodiments of the present invention relate to an organic light emitting display device.

Discussion of the Related Art

Various flat panel displays such as liquid crystal display device, plasma display panel and organic light emitting display device are now used. The organic light emitting display device has attracted attention because it has a rapid response speed and a low power consumption. In addition, because the organic light emitting display device emits light itself, there is not a problem related with a viewing angle.

In more detail, FIG. 1 is a circuit diagram illustrating a pixel structure of related art organic light emitting display device. Referring to FIG. 1, each pixel includes a switching transistor (Tsw), a driving transistor (Tdr), a capacitor (Cst), and an organic light emitting diode (OLED). Further, the switching transistor (Tsw) is switched by a scan pulse (SP) supplied to a scan control line (SL), and the switching transistor (Tsw) supplies a data voltage (Vdata) supplied to a data line (DL) to a driving transistor (Tdr).

In addition, the driving transistor (Tdr) is switched by the data voltage (Vdata) supplied from the switching transistor (Tsw), and the driving transistor (Tdr) controls a data current (bled) flowing to the OLED from a driving power source (EVdd) supplied from a driving power line. As shown, the capacitor (Cst) is connected between gate and source terminals of the driving transistor (Tdr), where the capacitor (Cst) stores a voltage corresponding to the data voltage (Vdata) supplied to the gate terminal of the driving transistor (Tdr), and turns-on the driving transistor (Tdr) using the stored voltage.

The OLED is electrically connected between cathode line (EVss) and source terminal of the driving transistor (Tdr), whereby the OLED emits light by the data current (Ioled) supplied from the driving transistor (Tdr). Further, each pixel (P) controls an intensity of the data current (Ioled) flowing in the OLED by switching the driving transistor (Tdr) according to the data voltage (Vdata), whereby the OLED emits light, thereby displaying a predetermined image.

However, in the related art OLED, the threshold voltage (Vth) characteristics of the driving transistor (Tdr) may be different in each position due to non-uniformity when manufacturing the thin film transistor. Accordingly, even though the data voltage (Vdata) is identically applied to the driving transistor (Tdr) for each pixel, a uniform picture quality is difficult to achieve because of the deviation of the current flowing in the OLED.

In order to overcome the problem related to the non-uniformity of picture quality, the Unexamined Publication Number P10-2012-0076215 in the Korean Intellectual Property Office discloses an OLED including a sensor transistor for each pixel, which enables external compensation techniques for sensing a threshold voltage of driving transistor through a reference line connected with the sensor transistor, and compensating for the threshold voltage of driving transistor. However, the number of reference lines is the same as the number of pixel columns so that it is difficult to design a source driver (D-IC) due to the increased number of channels of source driver (D-IC).

SUMMARY OF THE INVENTION

Accordingly, embodiments of the present invention are directed to an organic light emitting display device that substantially obviates one or more problems due to limitations and disadvantages of the related art.

One aspect of present invention is to provide an organic light emitting display device in which the number of source drivers is decreased by decreasing the number of reference lines to supply a reference voltage to pixels.

Another aspect of the present invention is to provide an organic light emitting display device which senses a driving characteristic value of a driving transistor of a pixel, and a driving characteristic value of an organic light emitting diode.

To achieve these and other advantages and in accordance with the purpose of embodiments of the invention, as embodied and broadly described herein, the present invention provides an organic light emitting display device including a display panel including a first pixel connected with a first data line and first and second scan lines, a second pixel connected with a second data line and the first and second scan lines, and a reference line connected in common with the first and second pixels; a source driver configured to operate first and second sensing modes for sensing driving characteristic values of the first and second pixels through the reference line; and a scan driver configured to drive the first and second scan lines so as to drive only the first pixel for the first sensing mode or only the second pixel for the second sensing mode.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of embodiments of the invention and are incorporated in and constitute a part of this application, illustrate embodiment(s) of the invention and together with the description serve to explain the principle of embodiments of the invention. In the drawings.

DETAILED DESCRIPTION OF THE INVENTION

Reference will now be made in detail to the embodiments of the present invention, examples of which are illustrated in the accompanying drawings. Wherever possible, the same reference numbers will be used throughout the drawings to refer to the same or like parts.

The term of a singular expression include a multiple expression as well as the singular expression if there is no specific definition in the context. If using the term such as "the first" or "the second," it is to separate any one element from other elements. Thus, a scope of claims is not limited by these terms. Also, the term such as "include" or "have" does not preclude existence or possibility of one or more features, numbers, steps, operations, elements, parts or their combinations.

Further, the term "at least one" includes all combinations related with any one item. For example, "at least one among a first element, a second element and a third element" may include all combinations of the two or more elements selected from the first, second and third elements as well as each element of the first, second and third elements.

Hereinafter, an organic light emitting display device according to embodiment of the present invention will be described in detail with reference to the accompanying drawings. In particular, FIG. 2 illustrates an organic light emitting display device according to the embodiment of the present invention, and FIG. 3 illustrates first and second pixels and a source driver shown in FIG. 2.

Figure 1:
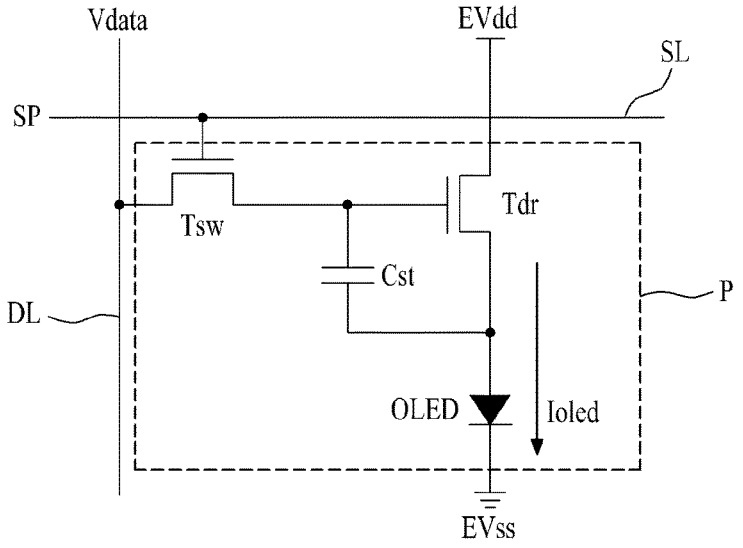
FIG. 1 Related Art
FIG. 1 is a circuit diagram illustrating a pixel structure of a related organic light emitting display device.
Figure 2:
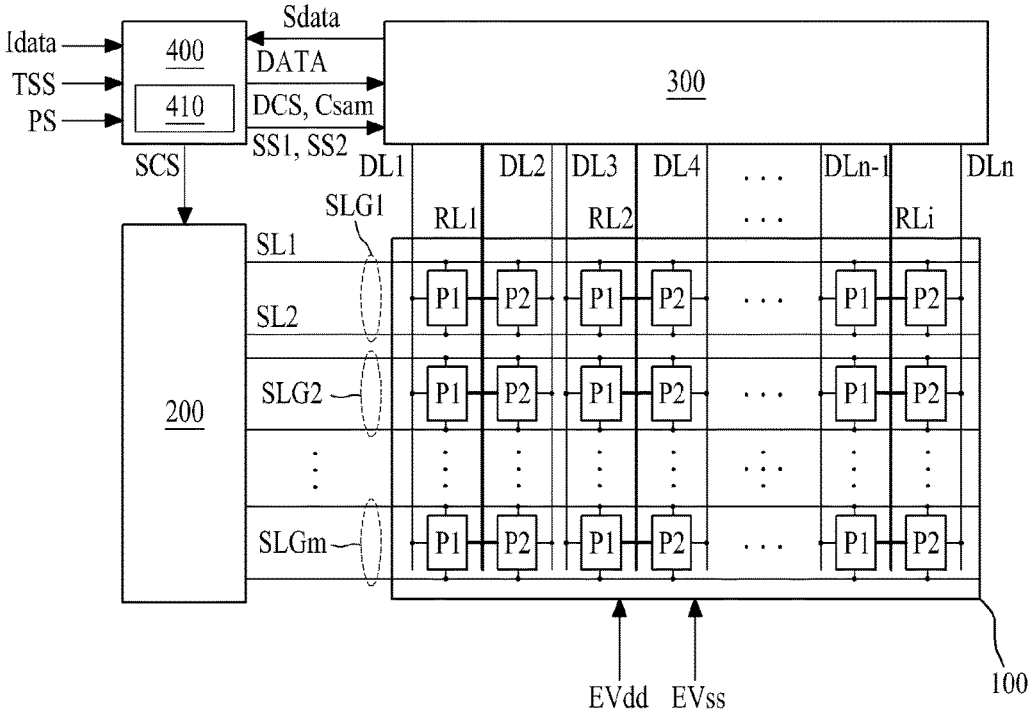
FIG. 2 illustrates an organic light emitting display device according to the embodiment of the present invention.
Figure 3:
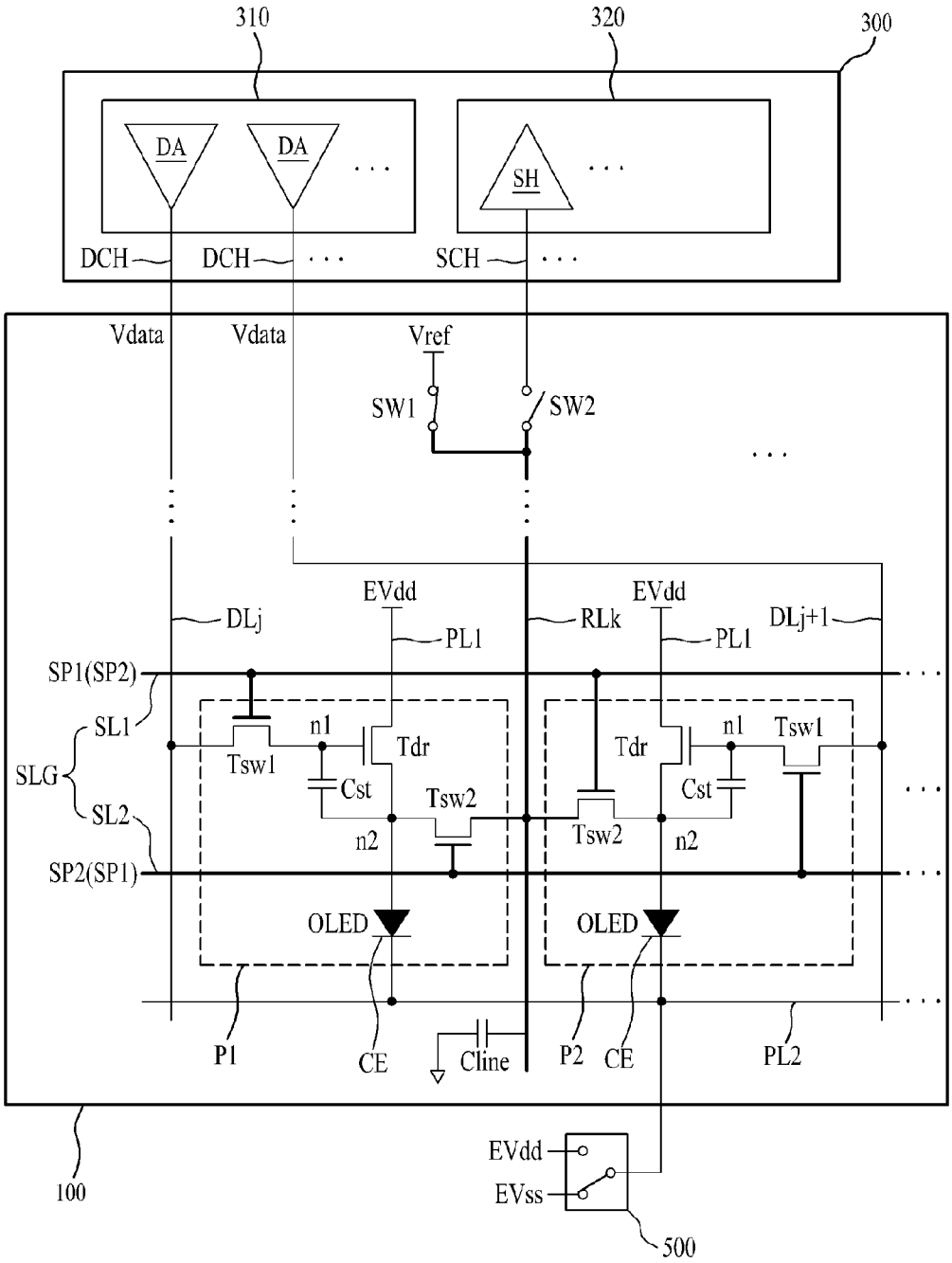
FIG. 3 illustrates first and second pixels and a source driver shown in FIG. 2.

Referring to FIGS. 2 and 3, the organic light emitting display device includes a display panel 100, a scan driver 200, a source driver 300, and a timing controller 400. The display panel 100 includes first to m-th scan line groups ('m' is an integer, SLG1 to SLGm), first to n-th data lines ('n' is an integer which is different from 'm'), first to i-th reference lines ('i' is n/2, RL1 to RLi), and a plurality of pixels (P1, P2).

The first to m-th scan line groups (SLG1 to SLGm) are formed in a first direction of the display panel 100, for example, each of the first to m-th scan line groups (SLG1 to SLGm) may be formed along a length direction of the display panel 100. In this instance, each of the first to m-th scan line groups (SLG1 to SLGm) include first and second scan lines (SL1, SL2) being adjacent to each other. The first and second scan lines (SL1, SL2) may be individually supplied with first and second scan pulses from the scan driver 200.

The first to n-th data lines (DL1 to DLn) are formed in a second direction of the display panel 100, wherein each of the first to n-th data lines (DL1 to DLn) is perpendicular to each of the first to m-th scan line groups (SLG1 to SLGm). For example, the first to n-th data lines (DL1 to DLn) may be formed in a breadth direction of the display panel 100. Each of the data lines (DL1 to DLn) can be individually supplied with a data voltage (Vdata) from the source driver 300.

As shown, the first to i-th reference lines (RL1 to RLi) are formed in parallel with the first to n-th data lines (DL1 to DLn), wherein each of the first to i-th reference lines (RL1 to RLi) is positioned between the neighboring two data lines (DL). Accordingly, the 'i' reference lines (RL1 to RLi) are formed on the display panel 100, wherein 'i' corresponding to the number of reference lines (RL1 to RLi) is half of 'n' corresponding to the number of data lines (DL1 to DLn).

Further, each of the first pixels (P1) are connected with the first data line (DLj) corresponding to any one of the neighboring two data lines (DLj, DLj+1, 'j' is an integer), the first and second scan lines (SL1, SL2), and one reference line (RLk, 'k' is an integer from 1 to 'i'). For example, the first pixel (P1) arranged along a length direction of the scan line (SL) are connected with the odd-numbered data line (DL) among the first to n-th data lines (DL1 to DLn), that is, may form the odd-numbered pixel column of the display panel 100.

Each of the second pixels (P2) is connected with the second data line (DLj+1) corresponding to the remaining one of the neighboring two data lines (DLj, DLj+1, 'j' is an integer), the first and second scan lines (SL1, SL2), and one reference line (RLk) For example, the second pixel (P1) arranged along a length direction of the scan line (SL) is connected with the even-numbered data lines (DL) among the first to n-th data lines (DL1 to DLn), that is may form the even-numbered pixel column of the display panel 100.

In addition, the first and second pixels (P1, P2) are connected in common with one reference line (RLk) formed between the neighboring first and second data lines (DLj, DLj+1, 'j' is an integer). That is, the first and second pixels (P1, P2) are individually connected with the neighboring data lines while being connected with one reference line (RLk) in common.

Each of the first and second pixels (P1, P2) include a first switching transistor (Tsw1), a second switching transistor (Tsw2), a driving transistor (Tdr), a capacitor (Cst), and an organic light emitting diode (OLED). In this instance, the transistor (Tsw1, Tsw2, Tdr) corresponds to a N-type transistor (TFT), for example, a-Si TFT, poly-Si TFT, Oxide TFT, or Organic TFT.

The first switching transistor (Tsw1) of the first pixel (P1) is switched by a first scan pulse (SP1) supplied to the first scan line (SL1), whereby the first switching transistor (Tsw1) being switched outputs the data voltage (Vdata), supplied to the data line (DL), to a first node (n1). Thus, the first switching transistor (Tsw1) of the first pixel (P1) includes a gate electrode connected with the first scan line (SL1), a source electrode connected with the first data line (DLj), and a drain electrode connected with the first node (n1) corresponding to a gate electrode of the driving transistor (Tdr) of the first pixel (P1).

Further, the second switching transistor (Tsw2) of the first pixel (P1) is switched by a second scan pulse (SP2) supplied to the second scan line (SL2), whereby the second switching transistor (Tsw2) being switched outputs a reference voltage (Vref), supplied to the reference line (RLk), to a second node (n2) corresponding to a source electrode of the driving transistor (Tdr) of the first pixel (P1). Thus, the second switching transistor (Tsw2) of the first pixel (P1) includes a gate electrode connected with the second scan line (SL2), a source electrode connected with the reference line (RLk), and a drain electrode connected with the second node (n2).

The capacitor (Cst) of the first pixel (P1) includes a first electrode connected with a first node (n1), that is, the gate electrodes of the driving transistor (Tdr) of the first pixel (P1) and a second electrode connected with a second node (2), that is the source electrode of the driving transistor (Tdr) of the first pixel (P1). After a differential voltage between the respective voltages supplied to the first and second node (n1, n2) is charged in the capacitor (Cst) of the first pixel (P1) in accordance with the switching of the first and second switching transistors (Tsw1, Tsw2) of the first pixel (P1), the driving transistor (Tdr) of the first pixel (P1) is switched in accordance with the charged voltage.

As the driving transistor (Tdr) of the first pixel (P1) is turned-on by the voltage of the capacitor (Cst) of the first pixel (P1), an amount of current flowing to the OLED of the first pixel (P1) can be controlled from a first driving power line (PL1). Thus, the driving transistor (Tdr) of the first pixel (P1) includes a gate electrode connected with the first node (n1), a source electrode connected with the second node (n2), and a drain electrode connected with the first driving power line (PL1).

Further, the OLED of the first pixel (P1) emits monochromatic light with a luminance corresponding to a data current (Ioled) flowing in accordance with the driving of the driving transistor (Tdr) of the first pixel (P1). The first switching transistor (Tsw1) of the second pixel (P2) is switched by the second scan pulse (SP2) supplied to the second scan line (SL2), whereby the first switching transistor (Tsw1) being switched outputs the data voltage (Vdata), supplied to the data line (DL), to a first node (n1).

Thus, the first switching transistor (Tsw1) of the second pixel (P2) includes a gate electrode connected with the second scan line (SL2), a source electrode connected with the second data line (DLj+1), and a drain electrode connected with the first node (n1) corresponding to a gate electrode of the driving transistor (Tdr) of the second pixel (P2). The second switching transistor (Tsw2) of the second pixel (P2) is switched by the first scan pulse (SP1) supplied to the first scan line (SL1), whereby the second switching transistor (Tsw2) being switched outputs the reference voltage (Vref), supplied to the reference line (RLk), to a second node (n2) corresponding to a source electrode of the driving transistor (Tdr) of the second pixel (P2).

Thus, the second switching transistor (Tsw2) of the second pixel (P2) includes a gate electrode connected with the first scan line (SL1), a source electrode connected with the reference line (RLk), and a drain electrode connected with the second node (n2). The capacitor (Cst) of the second pixel (P2) includes a first electrode connected with a first node (n1), that is, the gate electrodes of the driving transistor (Tdr) of the first pixel (P2) and a second electrode connected with a second node (2), that is the source electrode of the driving transistor (Tdr) of the first pixel (P2).

After a differential voltage between the respective voltages supplied to the first and second node (n1, n2) is charged in the capacitor (Cst) of the second pixel (P2) in accordance with the switching of the first and second switching transistors (Tsw1, Tsw2) of the second pixel (P2), the driving transistor (Tdr) of the second pixel (P2) is switched in accordance with the charged voltage.

As the driving transistor (Tdr) of the second pixel (P2) is turned-on by the voltage of the capacitor (Cst) of the second pixel (P2), an amount of current flowing to the OLED of the second pixel (P2) can be controlled from a first driving power line (PL1). Thus, the driving transistor (Tdr) of the second pixel (P2) includes a gate electrode connected with the first node (n1), a source electrode connected with the second node (n2), and a drain electrode connected with the first driving power line (PL1).

Further, the OLED of the second pixel (P2) emits monochromatic light with a luminance corresponding to a data current (Ioled) flowing in accordance with the driving of the driving transistor (Tdr) of the second pixel (P2). In addition, the OLED for each of the first and second pixels (P1, P2) may include an anode electrode connected with the second node (n2), an organic layer formed on the anode electrode, and a cathode electrode connected with the organic layer. In this instance, the organic layer may be formed in a deposition structure of hole transport layer/organic light emitting layer/electron transport layer or a deposition structure of hole injection layer/hole transport layer/organic light emitting layer/electron transport layer/electron injection layer. Furthermore, the organic layer may include a functional layer for improving light-emitting efficiency and/or lifespan of the organic light emitting layer. Also, the cathode electrode may be connected with a second driving power line formed every pixel column or connected with all the pixels (P1, P2) in common.

In addition, the first and second pixels (P1, P2) are operated in a display mode for displaying images, and a sensing mode. In more detail, the sensing mode may be defined by the driving of pixel (or organic light emitting display device) for dividing and sensing driving characteristic values of the first and second pixels (P1, P2) by first and second sensing modes through the reference line (RL) used by the first and second pixels (P1, P2) in common.

The driving characteristic values of the first and second pixels (P1, P2) may correspond to driving characteristic values of the driving transistor (Tdr) or driving characteristic values of the OLED. In this instance, the driving characteristic value of the driving transistor (Tdr) may be a current flowing in the driving transistor (Tdr) or a threshold voltage of the driving transistor (Tdr). Also, the driving characteristic value of the OLED may be a current flowing in the OLED or a threshold voltage of the OLED.

The first sensing mode may be the driving of a pixel for sensing the driving characteristic value of the first pixel (P1), wherein the first sensing mode may include a first TFT sensing mode for sensing the driving characteristic value of the driving transistor (Tdr) of the first pixel (P1), and a first OLED sensing mode for sensing the driving characteristic value of the OLED of the first pixel (P1). The second sensing mode may be the driving of a pixel for sensing the driving characteristic value of the second pixel (P2), wherein the second sensing mode may include a second TFT sensing mode for sensing the driving characteristic value of the driving transistor (Tdr) of the second pixel (P2), and a second OLED sensing mode for sensing the driving characteristic value of the OLED of the second pixel (P2).

Further, the sensing mode may be performed for a plurality of frames in a method for sensing at least one horizontal line every vertical blank period or every horizontal blank period; or may be sequentially performed for all horizontal lines in at least one frame every power-on period of the organic light emitting display device, every power-off period of the organic light emitting display device, every power-on period after a preset driving time or every power-off period after a preset driving time.

In this instance, the vertical blank period may be overlapped with a blank period of a vertically-synchronized signal, or a blank period of a vertically-synchronized signal in a period between the last data enable signal of previous frame and the first data enable signal of present frame. The horizontal blank period may be overlapped with a blank period of a horizontally-synchronized signal in a period between the last point for data output point of previous horizontal line and the start point for data output of present horizontal line.

As shown in FIG. 3, the display panel 100 includes a first switch (SW1) connected with each reference line between the reference line (RL1 to RLi) and a reference voltage supply line supplied with the reference voltage (Vref), and a second switch (SW2) connected with each sensing channel between each of the first to i-th reference lines (RL1 to RLi) and a sensing channel (SCH) of the source driver 300.

The first switch (SW1) is turned-on by a first switch on/off signal (SS1) supplied from the timing controller 400 in accordance with the sensing mode or display mode, whereby the reference voltage (Vref) is supplied to the corresponding reference line (RL). The second switch (SW2) is turned-on by a second switch on/off signal (SS2) supplied from the timing controller 400 in accordance with the sensing mode or display mode, whereby the sensing channel (SCH) of the source driver 300 is connected with the corresponding reference line (RL).

The organic light emitting display device according to an embodiment of the present invention may further include a voltage selector 500 which selects a high-potential voltage (EVdd) or low-potential voltage (EVss) in accordance with a voltage select signal provided from the timing controller 400 by the sensing mode or display mode, and supplies the selected voltage to the second driving power line (PL2) of the display panel 100.

That is, for the TFT sensing mode, the voltage selector 500 supplies the high-potential voltage (EVdd) to the cathode electrode of the OLED through the second driving power line (PL2). Meanwhile, for the OLED sensing mode and the display mode, the voltage selector 500 supplies the low-potential voltage (EVss) to the cathode electrode of the OLED through the second driving power line (PL2). The voltage selector 500 may be provided inside a voltage generator, or may be positioned between the display panel 100 and the voltage generator.

The scan driver 200 sequentially drives the first and second scan lines (SL1, SL2) of the first to m-th scan line groups (SLG1 to SLGm) in response to a scan control signal (SCS) supplied from the timing controller 400 according to the sensing mode or display mode. That is, for the display mode and the first sensing mode, the scan driver 200 supplies the first scan pulse (SP1) to each first scan line (SL1) of the first to m-th scan line groups (SLG1 to SLGm) in sequence, and also supplies the second scan pulse (SP2) to each second scan line (SL2) of the first to m-th scan line groups (SLG1 to SLGm) in sequence.

For the second sensing mode of the sensing mode, the scan driver 200 supplies the first scan pulse (SP1) to each second scan line (SL2) of the first to m-th scan line groups (SLG1 to SLGm) in sequence, and also supplies the second scan pulse (SP2) to each first scan line (SL1) of the first to m-th scan line groups (SLG1 to SLGm) in sequence. In addition, the source driver 300 is connected with the first to n-th data lines (DL1 to DLm), and is also connected with the first to i-th reference lines (RL1 to RLi). The source driver 300 may include a data driver 310 and a sensing part 320.

Further, the data driver 310 converts pixel data (DATA) supplied from the timing controller 400 according to the display mode or sensing mode into the data voltage (Vdata) in accordance with a data control signal (DCS) supplied from the timing controller 400, and supplies the data voltage (Vdata) to the corresponding data line (DL1 to DLn) through a corresponding data channel (DCH). Thus, the data driver 310 may include a shift register, a latch, a grayscale voltage generator, and first to n-th digital-to-analog converters (DA).

The shift register shifts a source start signal of the data control signal (DCS) in accordance with a source shift clock of the data control signal (DCS), and sequentially outputs the sampling signal. The latch sequentially samples and latches the pixel data (DATA) in accordance with the sampling signal, and outputs the latch data of one horizontal line in accordance with a source output enable signal for the data control signal (DCS).

In addition, the grayscale voltage generator generates a plurality of grayscale voltages corresponding to the number of grayscales of the pixel data (DATA) by a plurality of externally-provided reference gamma voltages. Each of the first to n-th digital-to-analog converters (DA) selects the grayscale voltage corresponding to the latch data among the plurality of grayscale voltages supplied from the grayscale voltage generator, uses the selected grayscale voltage as the data voltage (Vdata), and outputs the selected grayscale voltage to the corresponding data line (DL1 to DLn).

Further, the sensing part 320 senses the driving characteristic value of the first pixel (P1) through the first to i-th reference lines (RL1 to RLi) for the first sensing mode, and senses the driving characteristic value of the second pixel (P2) through the first to i-th reference lines (RL1 to RLi) for the second sensing mode. That is, the sensing part 320 senses the current flowing in the reference line (RL) in accordance of the driving of first or second pixel (P1, P2) for the first or second sensing mode, generates sensing data (Sdata) using the sensed current, and provides the generated sensing data (Sdata) to the timing controller 400.

Figure 4:
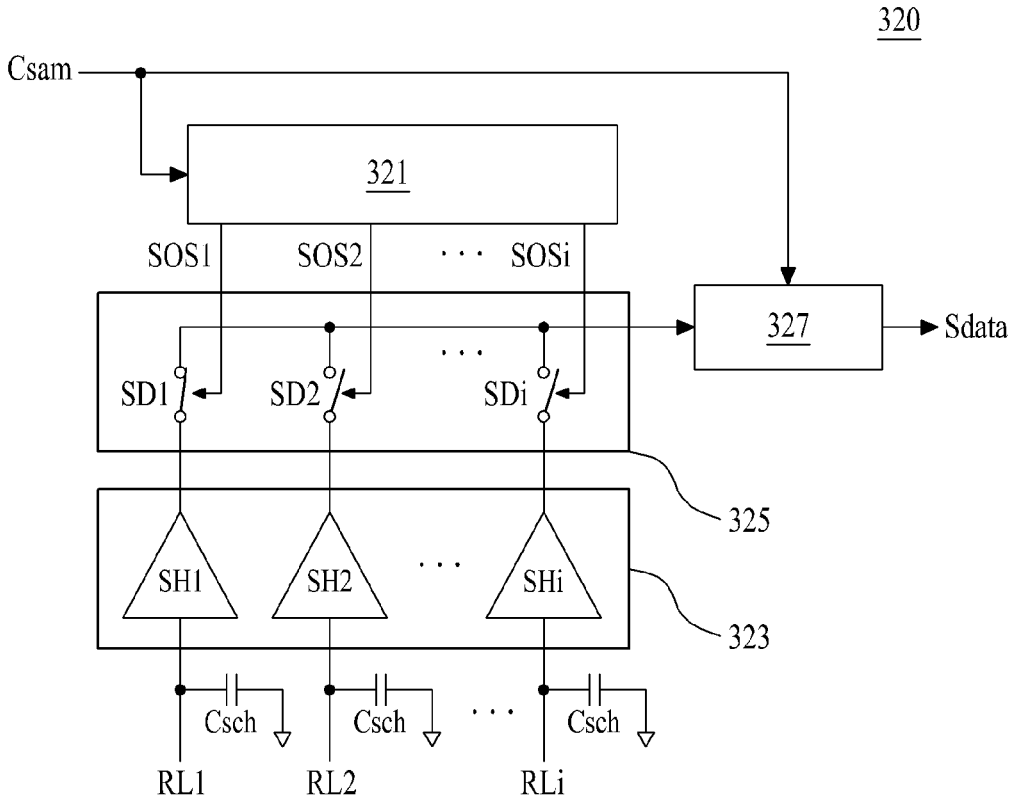
FIG. 4 illustrates a sensing part shown in FIG. 3.

As shown in FIG. 4, the sensing part 320 according to one embodiment of the present invention includes a shift register 321, a sampling/holding part 323, an output switch 325, and an analog-to-digital converter 327. The shift register 321 generates and outputs first to i-th sampling output signals (SOS1 to SOSi) which are sequentially shifted in accordance with a sampling clock signal (Csam) supplied from the external, that is, timing controller 400.

The sampling/holding part 323 includes first to i-th sensing channels (SCH), and first to i-th sampling/holders (SH1 to SHi) connected with the first to i-th reference lines (RL1 to RLi) by each channel. Each of the first to i-th sampling/holders (SH1 to SHi) samples a sensing voltage corresponding to the current flowing in the reference line (RL) by the driving of first or second pixel (P1, P2) in accordance with the first or second sensing mode, and holds the sampled sensing voltage.

A sensing channel capacitor (Csch) is also connected in parallel with the first to i-th sensing channels (SCH). The output switch 325 includes first to i-th switching elements (SD1 to SDi) respectively connected with output terminals of the first to i-th sampling/holders (SH1 to SHi). As the first to i-th switching elements (SD1 to SDi) are sequentially switched in accordance with the first to i-th sampling output signals (SOS1 to SOSi) sequentially output from the shift register 321, the sensing voltages being held in the first to i-th sampling/holders (SH1 to SHi) are sequentially supplied to the analog-to-digital converter 327.

The analog-to-digital converter 327 generates sensing data (Sdata) by converting the sensing voltage sequentially supplied from the output switch 325 into digital data, and provides the generated sensing data (Sdata).

Referring again to FIGS. 2 and 3, the timing controller 400 operates the scan driver 200 and the source driver 300 in the first sensing mode, the second sensing mode or the display panel based on power on/off signal (PS) supplied from an external driving system or vertically-synchronized signal of timing synchronized signal (TSS). In this instance, the timing synchronized signal (TSS) may include vertically-synchronized signal, horizontally-synchronized signal, data enable signal and clock signal.

For the first sensing mode, the timing controller 400 generates signals (DATA, DCS, SCS, Csam) needed to drive the scan driver 200 and the source driver 300 so as to make the current flow in the reference line (RL) in accordance with the driving of first pixel (P1). For the second sensing mode, the timing controller 400 generates signals (DATA, DCS, SCS, Csam) needed to drive the scan driver 200 and the source driver 300 so as to make the current flow in the reference line (RL) in accordance with the driving of second pixel (P2).

For the sensing mode, the timing controller 400 detects a pixel current for each pixel based on sensing data (Sdata) for each pixel provided from the sensing part 320 of the source driver 300, calculates an offset value for each pixel and a gain value for each pixel using the pixel current for each pixel, and stores the calculated values in a memory 410. For the display mode, the timing controller 400 corrects input data (Idata) for each pixel in accordance with the offset value and gain value stored in the memory 410, and provides the corrected input data to the source driver 300.

In more detail, for the sensing mode, the timing controller 400 detects a characteristic variation in accordance with the pixel current of driving transistor (Tdr) for each pixel using sensing data (Sdata) for each pixel provided from the sensing part 320 of the source driver 300, and compensates for the data using the characteristic variation. In other words, the timing controller 400 calculates compensation data for each pixel so as to compensate for mobility and threshold voltage of driving transistor (Tdr) for each pixel based on pixel current for each pixel in accordance with the sensing data (Sdata) for each pixel, stores the calculated compensation data in the memory 410, and corrects the corresponding input data using the compensation data for each pixel stored in the memory 410 for the display mode.

In the organic light emitting display device according to the embodiment of the present invention, the first and second pixels (P1, P2) of the neighboring two pixels in the length direction of the scan line (SL) are connected with one reference line (RL) in common, whereby the reference lines (RL) of the display panel 100 are reduced by half so that the number of reference lines (RL) formed on the display panel 100 is the half of the number of data lines (DL).

Thus, in comparison to the number of data lines (DL), the number of sensing channels prepared in the source driver 300 connected in one-to-one correspondence with the reference lines (RL) formed on the display panel 100 is reduced by half so that it is possible to reduce the number of channels of the source driver 300, which enables to facilitate a design of the source driver 300.

According to the structure of the present invention in which the neighboring two pixels of the first and second pixels (P1, P2) use one reference line (RL) in common, the driving characteristic values of the first and second pixels (P1, P2) can be sensed through the first and second sensing modes, and improved picture quality can be achieved by compensating the driving variation for each pixel in the method of correcting the data for the corresponding pixel based on the sensing data for each pixel.

Figure 5A:
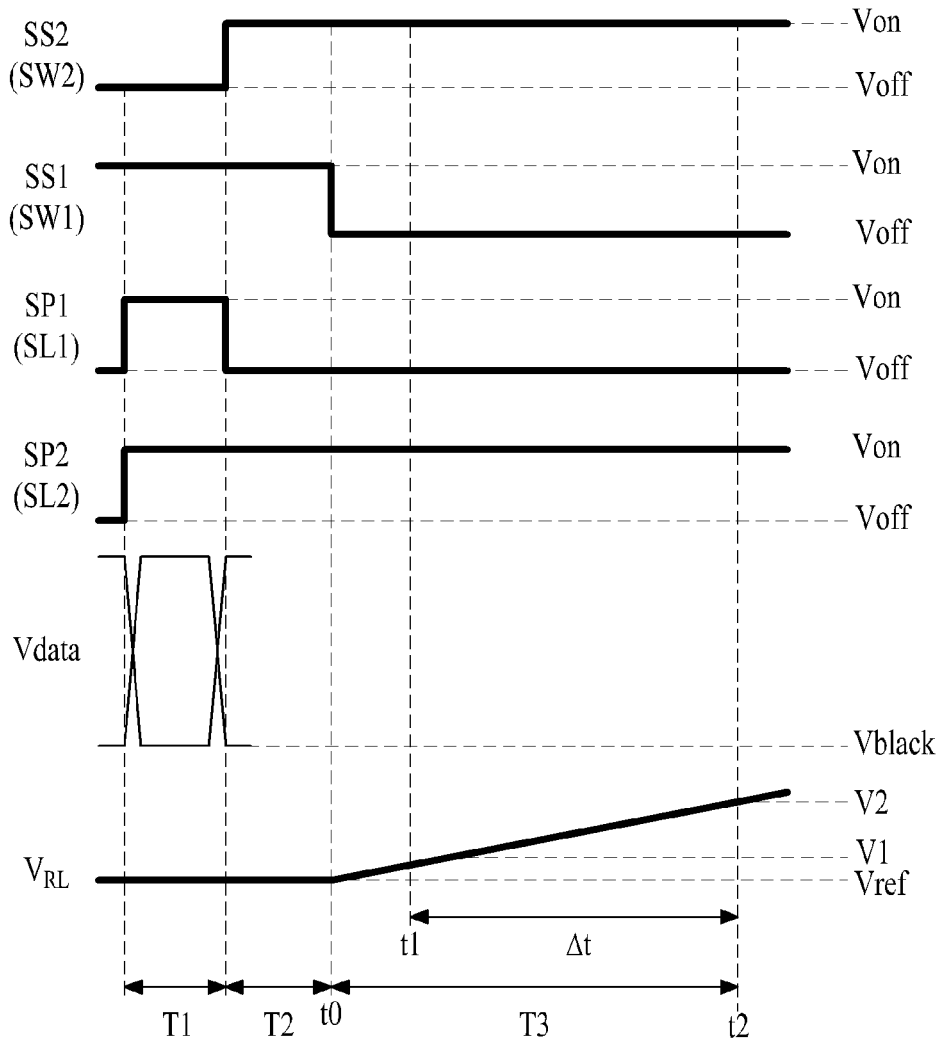
FIG. 5A is a waveform diagram showing a driving waveform of first and second pixels in accordance with a first TFT sensing mode of a first sensing mode in the organic light emitting display device according to the embodiment of the present invention.
Figure 5B:
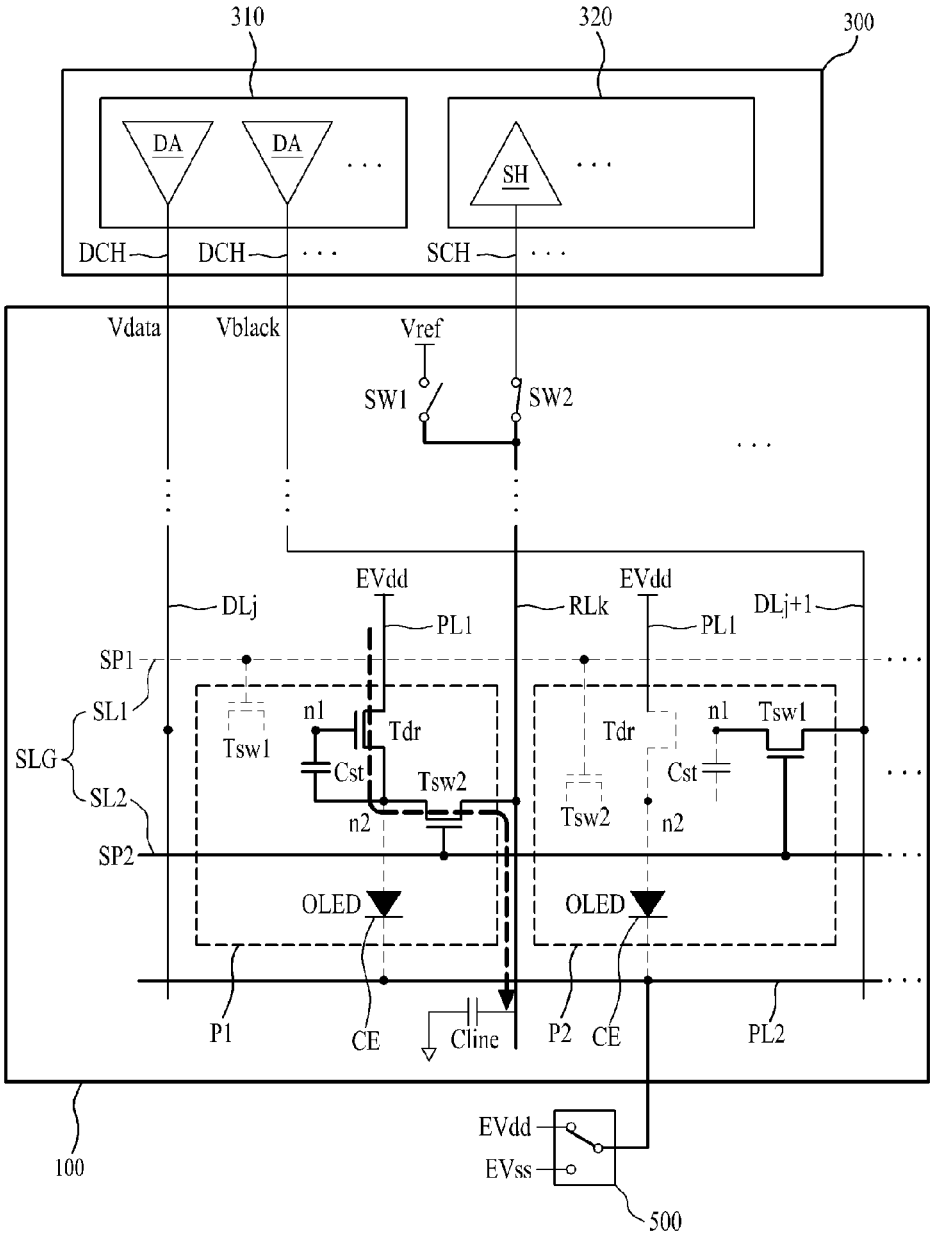
FIG. 5B illustrates driving of first and second pixels in accordance with a sensing period in the driving waveform shown in FIG. 5A.

In the present invention, FIG. 5A is a waveform diagram showing a driving waveform of first and second pixels in accordance with the first TFT sensing mode of the first sensing mode, and FIG. 5B illustrates the driving of first and second pixels in accordance with a sensing period of the driving waveform shown in FIG. 5A. In more detail, a method for sensing the current flowing in the driving transistor of the first pixel, that is, the driving characteristic value of the first pixel in accordance with the first TFT sensing mode of the first sensing mode will be described with reference to FIGS. 5A and 5B.

First, the first TFT sensing mode of the first sensing mode may include an addressing period (T1), a pre-charging period (T2) and a sensing period (T3). In the first TFT sensing mode of the first sensing mode, the high-potential voltage (EVdd) selected by the voltage selector 500 is supplied to the second driving power line (PL2).

For the addressing period (T1), the reference voltage (Vref) is supplied to the reference line (RLk) as the first switch (SW1) is turned-on by the first on/off signal (SS1) of the switch-on voltage (Von), and the reference line (RLk) is disconnected from the sensing part 320 as the second switch (SW2) is turned-off by the second switch on/off signal (SS2) of the switch-off voltage (Voff). Also, all the first and second switching transistors (Tsw1, Tsw2) of the first and second pixels (P1, P2) are turned-on by the first and second scan pulses (SP1, SP2) of the gate-on voltage (Von) supplied from the scan driver 200 to the first and second scan lines (SL1, SL2). In synchronization with the above, a sensing data voltage (Vdata) is supplied from the source driver 300 to the first data line (DLj), and a black data voltage (Vblack), which is 0V or is not more than the threshold voltage of the driving transistor (Tdr), is supplied to the second data line (DLj+1).

Accordingly, the sensing data voltage (Vdata) and the reference voltage (Vref) are respectively supplied to the first and second nodes (n1, n2) of the first pixel (P1), whereby a differential voltage (Vdata-Vref) between the sensing data voltage (Vdata) and the reference voltage (Vref) is charged in the capacitor (Cst) of the first pixel (P1). In this instance, the black data voltage (Vblack) and the reference voltage (Vref) are supplied to the first and second nodes (n1, n2) of the second pixel (P2), whereby a differential voltage (Vblack-Vref) between the black data voltage (Vblack) and the reference voltage (Vref) is charged in the capacitor (Cst)

of the second pixel (P2). For the addressing period (T1), the organic light emitting diodes (OLED) of the first and second pixels (P1, P2) do not emit light due to the high-potential voltage (EVdd) supplied to the second driving power line (PL2).

For the pre-charging period (T2), the reference voltage (Vref) is supplied to the reference line (RLk) as the first switch (SW1) is maintained in the turned-on state by the first switch on/off signal (SS1) of the switch-on voltage (Von), and the reference line (RLk) is connected with the sensing part 320 as the second switch (SW2) is turned-on by the second switch on/off signal (SS2) of the switch-on voltage (Von). For the pre-charging period (T2), accordingly, the reference line (RLk), a parasitic capacitor (Cline) connected with the reference line (RLk) and the sensing channel capacitor (Csch, see FIG. 4) connected with the sensing channel (SCH) are pre-charged with the reference voltage (Vref).

For the pre-charging period (T2), each of the first switching transistor (Tsw1) of the first pixel (P1) and the second switching transistor (Tsw2) of the second pixel (P2) is turned-off by the first scan pulse (SP1) of the gate-off voltage (Voff) supplied from the scan driver 200 to the first scan line (SL1), and each of the second switching transistor (Tsw2) of the first pixel (P1) and the first switching transistor (Tsw1) of the second pixel (P2) is maintained in the turned-on statue by the second scan pulse (SP2) of the gate-on voltage (Von) supplied from the scan driver 200 to the second scan line (SL2).

For the sensing period (T3), the reference voltage (Vref) supplied to the reference line (RLk) is blocked as the first switch (SW1) is turned-off by the first switch on/off signal (SS1) of the switch-off voltage (Voff), and the connection between the reference line (RLk) and the sensing part 320 is maintained as the second switch (SW2) is maintained in the turned-on state by the second switch on/off signal (SS2) of the switch-on voltage (Von). Also, the first switching transistor (Tsw1) of the first pixel (P1) and the second switching transistor (Tsw2) of the second pixel (P2) are maintained in the turned-off state, and the second switching transistor (Tsw2) of the first pixel (P1) and the first switching transistor (Tsw1) of the second pixel (P2) are maintained in the turned-on state.

For the sensing period (T3), accordingly, even though the first switch (SW1) is turned-off, the voltage charged in the capacitor (Cst) of the second pixel (P2) is smaller than the threshold voltage of the driving transistor (Tdr) of the second pixel (P2), whereby the driving transistor (Tdr) of the second pixel (P2) is not driven and the current does not flow in the second pixel (P2).

Meanwhile, for the sensing period (T3), as the first switch (SW1) is turned-off, the driving transistor (Tdr) of the first pixel (P1) is driven by the voltage charged in the capacitor (Cst) of the first pixel (P1) so that the current of the first pixel (P1) flowing to the driving transistor (Tdr) of the first pixel (P1) from the first driving power line (PL1) flows in the sensing channel capacitor (Csch, see FIG. 4) and the parasitic capacitor (Cline) connected with the reference line (RLk) via the reference line (RLk). As a result, the voltage of the reference line (RLk) is linearly raised from the pre-charged reference voltage (Vref). Accordingly, the sensing part 320 of the source driver 300 generates the sensing data (Sdata) by sensing the first pixel current of the first pixel (P1) flowing in the reference line (RL) via the reference line (RLk), and provides the generated sensing data (Sdata) to the timing controller 400.

In more detail, the voltage of the reference line (RLk) is raised in proportion to the current of the first pixel (P1). Thus, if the second switch (SW2) is turned-off at a specific timing point (t2), and the voltage of the reference line (RLk) is sampled in the sampling/holder (SH) of the sensing part 320, the first pixel current ($I_{P1}$) flowing in the driving transistor (Tdr) of the first pixel (P1) may be calculated by (Math Formula 1) below.

$$I_{P1}(I_{P2}) = \frac{(Cline + Csch) \times (V2 - V1)}{(t2 - t1)} \quad \text{(Math Formula 1)}$$

In the above (Math Formula 1), '$I_{P1}$' is the first pixel current, 'Cline' is a capacitance of the parasitic capacitor connected with the reference line (RLk), 'Csch' is a capacitance of the sensing channel capacitor connected with the sensing channel (SCH) of the source driver, 'V1' is the voltage of the reference line (RLk) sampled at the time point of 't1' of the sensing period (T3) shown in FIG. 5A, and 'V2' is the voltage of the reference line (RLk) sampled at the time point of 't2' of the sensing period (T3) shown in FIG. 5A. For example, assuming the capacitance (Cline+Csch) of the capacitor connected with the reference line (RLk) is '50 pF', the voltage change between 't1' and 't2' (V2−V1) is '1V', and the time Δt(t2−t1) is '100 μs', the pixel current ($I_{P1}$) calculated by the above (Math Formula 1) is '500 nA'.

Additionally, if the voltage at a charging start point of the reference line (RLk) corresponds to the reference voltage (Vref), the voltage of the reference line (RLk) is sensed once at a time point of 't2', and the first pixel current ($I_{P1}$) can be calculated by (Math Formula 2) below.

$$I_{P1}(I_{P2}) = \frac{(Cline + Csch) \times (V2 - Vref)}{(t2 - t0)} \quad \text{(Math Formula 2)}$$

The sensing data (Sdata) corresponding to the first pixel current ($I_{P1}$) of the first pixel (P1), which is sensed for the first TFT sensing mode of the first sensing mode, is provided to the timing controller 400.

Figure 6A:
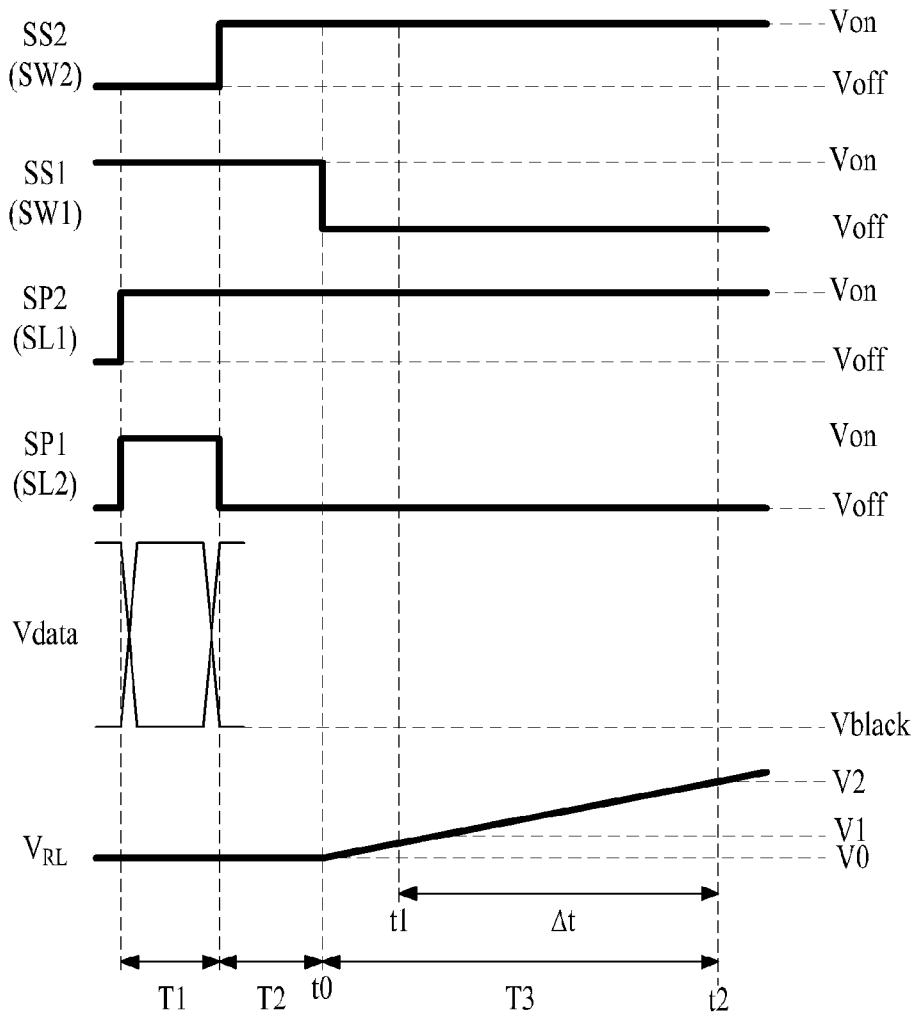
FIG. 6A is a waveform diagram showing a driving waveform of first and second pixels in accordance with a second TFT sensing mode of a second sensing mode in the organic light emitting display device according to the embodiment of the present invention.
Figure 6B:
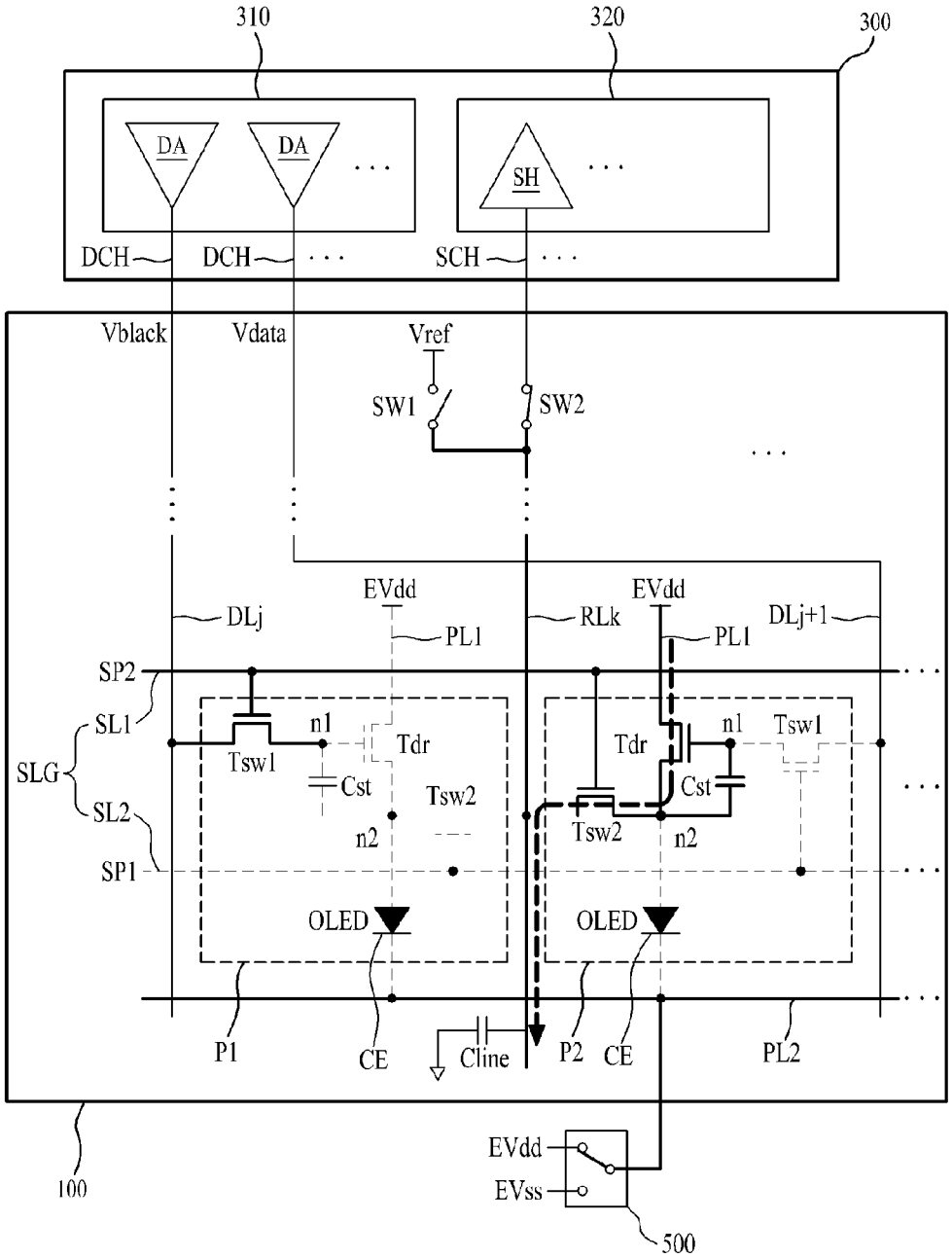
FIG. 6B illustrates driving of first and second pixels in accordance with a sensing period in the driving waveform shown in FIG. 6A.

Next, FIG. 6A is a waveform diagram showing a driving waveform of first and second pixels in accordance with the second TFT sensing mode of the second sensing mode, and FIG. 6B illustrates the driving of first and second pixels in accordance with a sensing period of the driving waveform shown in FIG. 6A. A method for sensing the current flowing in the driving transistor of the second pixel, that is, the driving characteristic value of the second pixel in accordance with the second TFT sensing mode of the second sensing mode will be described with reference to FIGS. 6A and 6B.

First, as in the first TFT sensing mode of the first sensing mode, the second TFT sensing mode of the second sensing mode may include an addressing period (T1), a pre-charging period (T2), and a sensing period (T3). Except that a black data voltage (Vblack) is supplied to the first data line (DLj), a sensing data voltage (Vdata) is supplied to the second data line (DLj+1), and the aforementioned second scan pulse (SP2) is supplied to the first scan line (SL1), and the aforementioned first scan pulse (SP1) is supplied to the second scan line (SL2), the remaining driving waveforms of the second TFT sensing mode are the same as those of the first TFT sensing mode.

For the sensing period (T3) of the second TFT sensing mode, as the first switch (SW1) is turned-off, the driving transistor (Tdr) of the second pixel (P2) is driven by the voltage charged in the capacitor (Cst) of the second pixel (P2) so that the current of the second pixel (P2) flowing to the driving transistor (Tdr) of the second pixel (P2) from the first driving power line (PL1) flows in the sensing channel capacitor (Csch, see FIG. 4) and the parasitic capacitor (Cline) connected with the reference line (RLk) via the reference line (RLk). As a result, the voltage of the reference line (RLk) is linearly raised from the pre-charged reference voltage (Vref). Accordingly, the sensing part 320 of the source driver 300 generates sensing data (Sdata) by sensing a second pixel current of the second pixel (P2) flowing in the reference line (RL), and provides the generated sensing data (Sdata) to the timing controller 400.

Meanwhile, for the sensing period (T3) of the second TFT sensing mode, even though the first switch (SW1) is turned-off, the voltage charged in the capacitor (Cst) of the first pixel (P1) is smaller than the threshold voltage of the driving transistor (Tdr) of the first pixel (P1), whereby the driving transistor (Tdr) of the first pixel (P1) is not driven and the current does not flow in the first pixel (P1). The sensing data (Sdata) corresponding to the second pixel current ($I_{P2}$) of the second pixel (P2), which is sensed for the second TFT sensing mode of the second sensing mode, is provided to the timing controller 400.

For each TFT sensing mode of the first and second sensing modes, the timing controller 400 detects the characteristic variation in the pixel current of the driving transistor (Tdr) for each pixel based on the sensing data (Sdata) for each pixel provided from the sensing part 320 of the source driver 300, and compensates for the data based on the characteristic variation. For example, the timing controller 400 calculates the sensing voltage in accordance with the sensing data (Sdata) for each pixel, and calculates the pixel current ($I_{P1}$, $I_{P2}$) of the driving transistor (Tdr) for each pixel through the (Math Formula 1) or (Math Formula 2). Herein, U.S. Pat. No. 7,982,695 discloses that the timing controller detects mobility variation of pixels (mobility ratio between corresponding pixel and reference pixel) and threshold voltage of driving transistor (Tdr) using the function for calculating a pixel current in accordance with threshold voltage and mobility, calculates gain data to compensate for the mobility variation and offset data to compensate for the detected threshold voltage, and stores the calculated gain data and offset data in a Look-up Table of memory 410, which is incorporated by reference in its entirety.

Figure 7A:
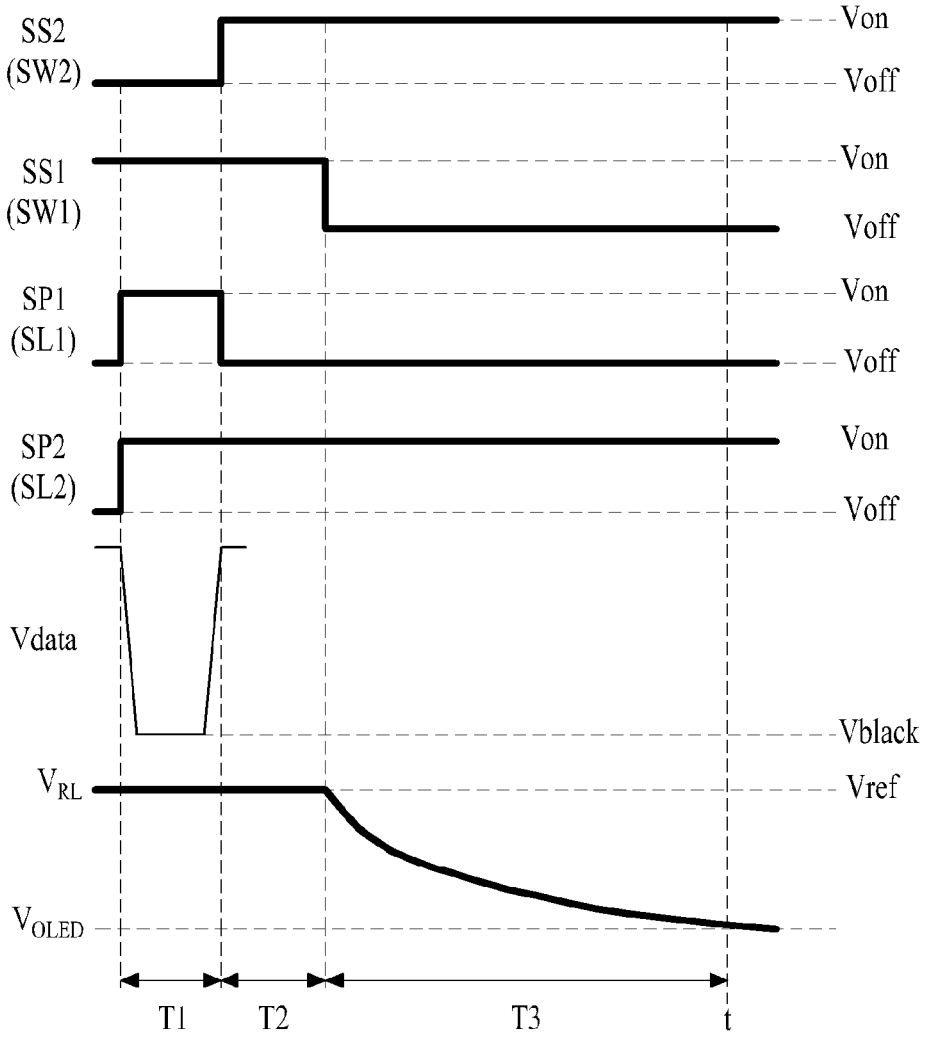
FIG. 7A is a waveform diagram showing a driving waveform of first and second pixels in accordance with a first OLED sensing mode of a first sensing mode in the organic light emitting display device according to the embodiment of the present invention.
Figure 7B:
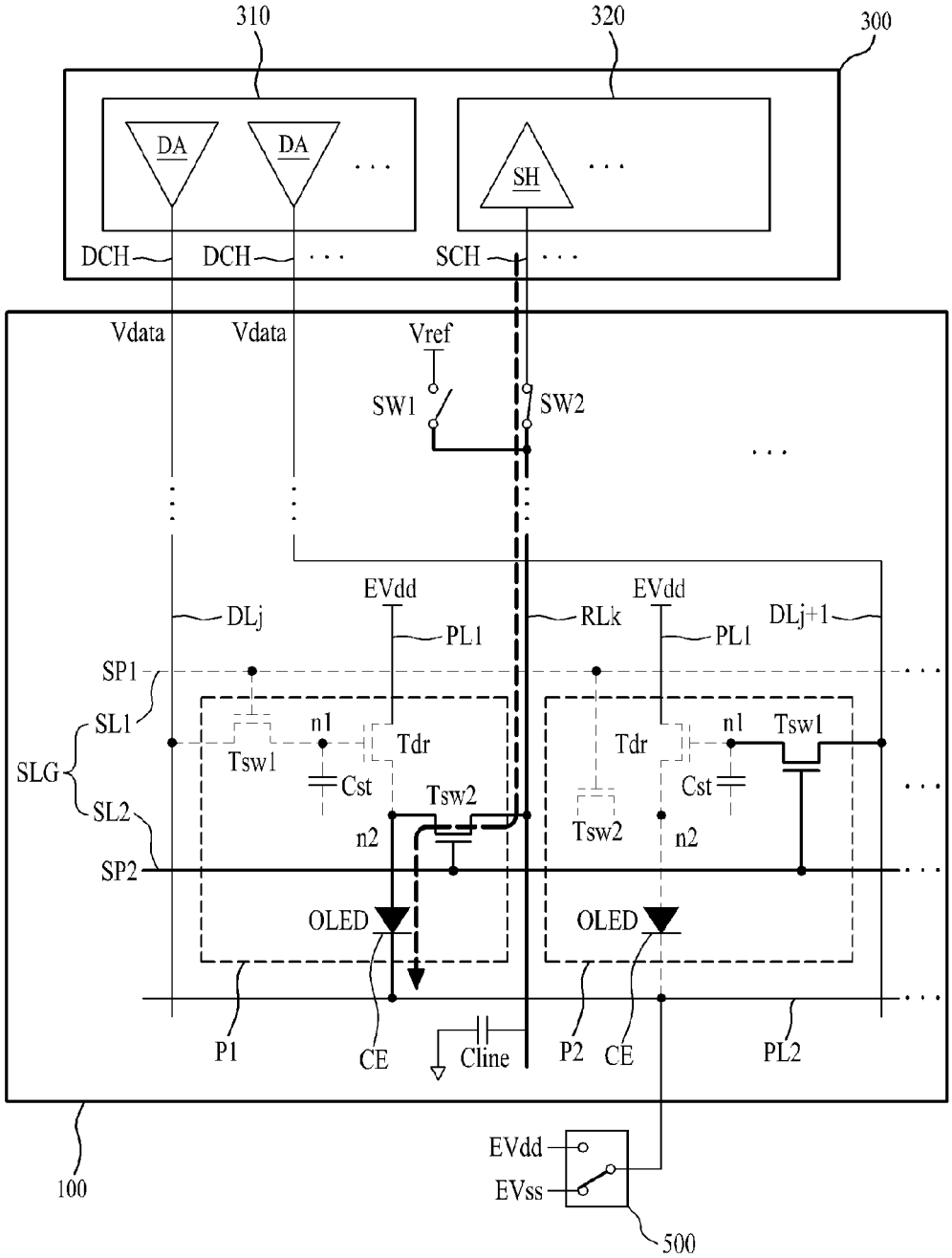
FIG. 7B illustrates driving first and second pixels in accordance with a sensing period in the driving waveform shown in FIG. 7A.

Next, FIG. 7A is a waveform diagram showing a driving waveform of first and second pixels in accordance with the first OLED sensing mode of the first sensing mode, and FIG. 7B illustrates the driving of first and second pixels in accordance with a sensing period of the driving waveform shown in FIG. 7A. A method for sensing the voltage of the OLED included in the first pixel, that is, the driving characteristic value of the first pixel in accordance with the first OLED sensing mode of the first sensing mode will be described with reference to FIGS. 7A and 7B.

First, as in the first TFT sensing mode of the first sensing mode, the first OLED sensing mode of the first sensing mode may include an addressing period (T1), a pre-charging period (T2) and a sensing period (T3). In the first OLED sensing mode of the first sensing mode, the low-potential voltage (EVss) selected by the voltage selector 500 is supplied to the second driving power line (PL2).

For the addressing period (T1), the reference voltage (Vref) is supplied to the reference line (RLk) as the first switch (SW1) is turned-on by the first on/off signal (SS1) of the switch-on voltage (Von), and the reference line (RLk) is disconnected from the sensing part 320 as the second switch (SW2) is turned-off by the second switch on/off signal (SS2) of the switch-off voltage (Voff). Also, all the first and second switching transistors (Tsw1, Tsw2) of the first and second pixels (P1, P2) are turned-on by the first and second scan pulses (SP1, SP2) of the gate-on voltage (Von) supplied from the scan driver 200 to the first and second scan lines (SL1, L2).

In synchronization with the above, a black data voltage (Vblack), which is 0V or is not more than the threshold voltage of the driving transistor (Tdr), is supplied to the first and second data lines (DLj, DLj+1) from the source driver 300. Accordingly, the black data voltage (Vblack) and the reference voltage (Vref) are respectively supplied to the first and second nodes (n1, n2) of the first and second pixels (P1, P2), whereby a differential voltage (Vblack−Vref) between the black data voltage (Vblack) and the reference voltage (Vref) is charged in the capacitor (Cst) of the first and second pixels (P1, P2). For the addressing period (T1), the organic light emitting diodes (OLED) of the first and second pixels (P1, P2) do not emit light due to the reference voltage (Vref) supplied to the second node (n2) through the turned-on second switching transistor (Tsw2).

For the pre-charging period (T2), the reference voltage (Vref) is supplied to the reference line (RLk) as the first switch (SW1) is maintained in the turned-on state by the first switch on/off signal (SS1) of the switch-on voltage (Von), and the reference line (RLk) is connected with the sensing part 320 as the second switch (SW2) is turned-on by the second switch on/off signal (SS2) of the switch-on voltage (Von). For the pre-charging period (T2), accordingly, the reference line (RLk), a parasitic capacitor (Cline) connected with the reference line (RLk) and the sensing channel capacitor (Csch, see FIG. 4) connected with the sensing channel (SCH) are pre-charged with the reference voltage (Vref).

For the pre-charging period (T2), each of the first switching transistor (Tsw1) of the first pixel (P1) and the second switching transistor (Tsw2) of the second pixel (P2) is turned-off by the first scan pulse (SP1) of the gate-off voltage (Voff) supplied from the scan driver 200 to the first scan line (SL1), and each of the second switching transistor (Tsw2) of the first pixel (P1) and the first switching transistor (Tsw1) of the second pixel (P2) is maintained in the turned-on statue by the second scan pulse (SP2) of the gate-on voltage (Von) supplied from the scan driver 200 to the second scan line (SL2).

For the sensing period (T3), the reference voltage (Vref) supplied to the reference line (RLk) is blocked as the first switch (SW1) is turned-off by the first switch on/off signal (SS1) of the switch-off voltage (Voff), and the connection between the reference line (RLk) and the sensing part 320 is maintained as the second switch (SW2) is maintained in the turned-on state by the second switch on/off signal (SS2) of the switch-on voltage (Von). Also, the first switching transistor (Tsw1) of the first pixel (P1) and the second switching transistor (Tsw2) of the second pixel (P2) are maintained in the turned-off state, and the second switching transistor (Tsw2) of the first pixel (P1) and the first switching transistor (Tsw1) of the second pixel (P2) are maintained in the turned-on state.

For the sensing period (T3), accordingly, the voltage charged in the capacitor (Cst) of each of the first and second pixels (P1, P2) is smaller than the threshold voltage of the corresponding driving transistor (Tdr), whereby the driving transistor (Tdr) of each of the first and second pixels (P1, P2) is not driven. Also, since the second switching transistor (Tsw2) of the first pixel (P1) is in the turned-off state, the OLED of the first pixel (P1) does not emit light so that the current does not flow in the first pixel (P1).

Meanwhile, as the first switch (SW1) is turned-off, the current flows from the reference line (RLk) to the second driving power line (PL2) through the second switching transistor (Tsw2) of the first pixel (P1) and the OLED due to the discharge of reference voltage (Vref) pre-charged in the sensing channel capacitor (Csch, see FIG. 4) and parasitic capacitor (Cline) connected with the reference line (RLk), whereby the voltage of the reference line (RLk) is reduced from the pre-charged reference voltage (Vref). Accordingly, the sensing part 320 of the source driver 300 generates sensing data (Sdata) by sensing the first pixel voltage corresponding to the voltage ($V_{OLED}$) between anode and cathode electrodes of the OLED of the first pixel (P1) through the reference line (RLk) at a specific time point (t) after the first switch (SW1) is turned-off, and then provides the generated sensing data (Sdata) to the timing controller 400.

In this instance, a light emitting amount of the OLED is proportional to the flowing current. However, if the OLED is degraded, a light emitting amount of the OLED is lowered under the condition of the same flowing current so that efficiency is lowered and thus the voltage of the OLED is raised. Based on current-voltage characteristics according to the degradation of the OLED, the voltage ($V_{OLED}$) between the anode and cathode electrodes of the OLED is sensed so as to obtain a more accurate degradation level of the OLED in the sensing part 320 for the first OLED sensing mode.

The sensing data (Sdata) corresponding to the first pixel voltage of the first pixel (P1), which is sensed for the first OLED sensing mode of the first sensing mode, is provided to the timing controller 400.

Figure 8A:
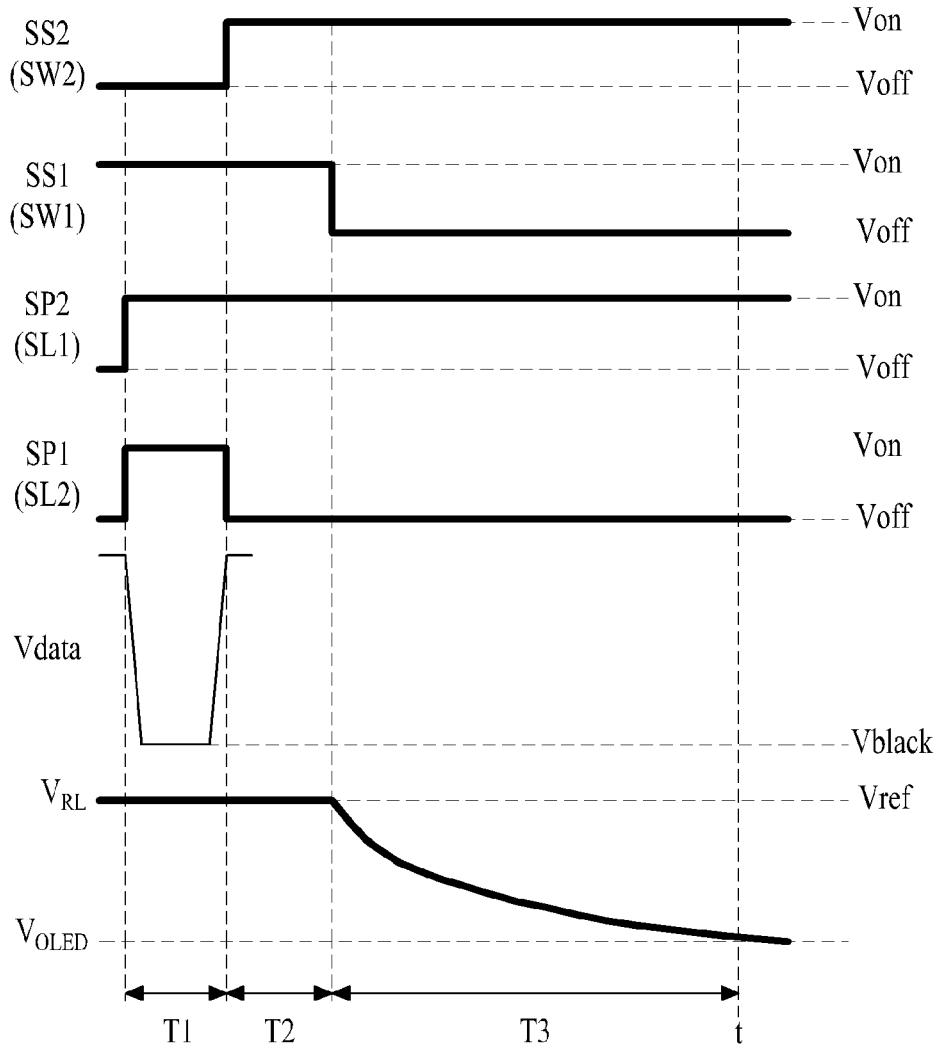
FIG. 8A is a waveform diagram showing a driving waveform of first and second pixels in accordance with a second OLED sensing mode of a second sensing mode in the organic light emitting display device according to the embodiment of the present invention.
Figure 8B:
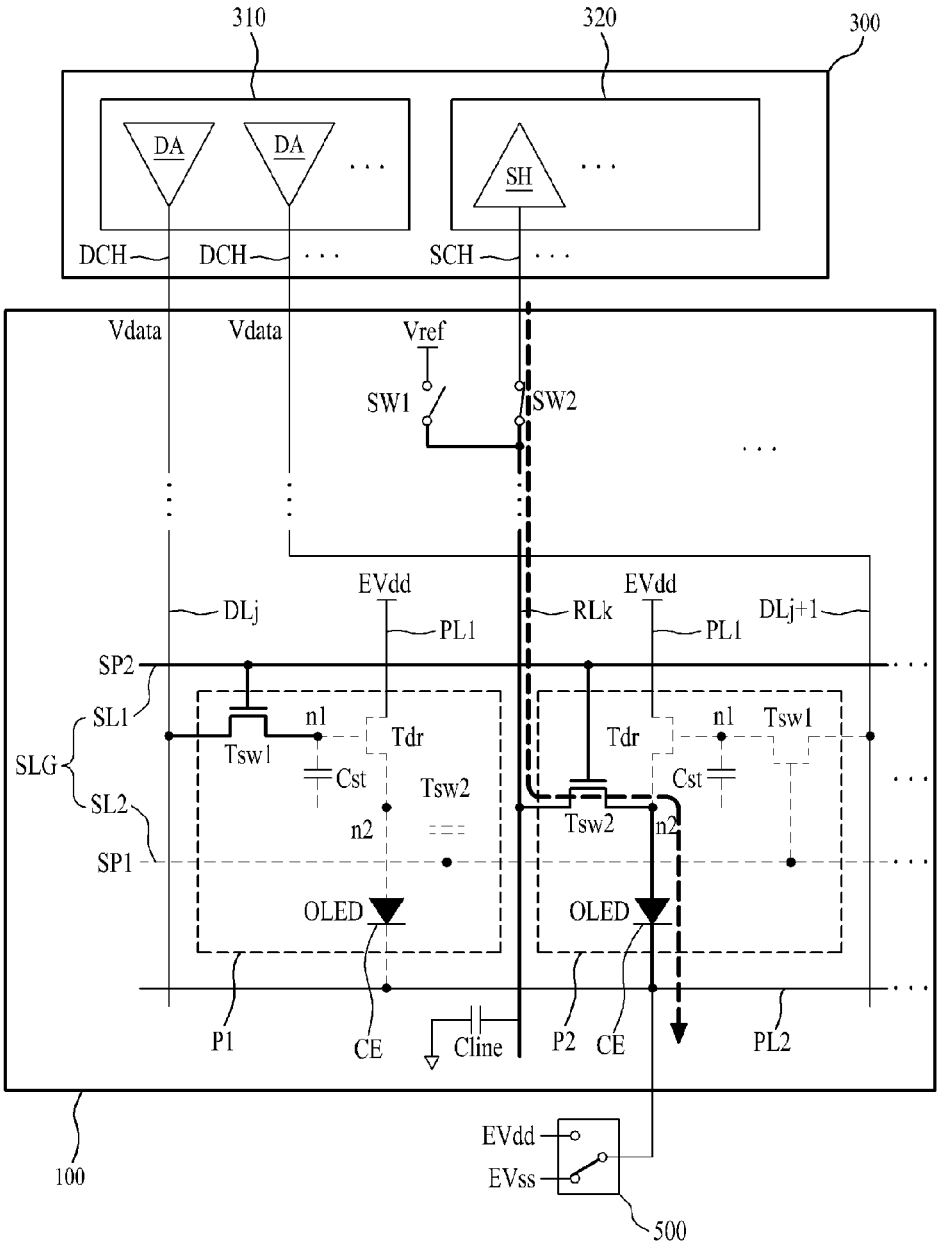
FIG. 8B illustrates driving first and second pixels in accordance with a sensing period in the driving waveform shown in FIG. 8A.

Next, FIG. 8A is a waveform diagram showing a driving waveform of first and second pixels in accordance with the second OLED sensing mode of the second sensing mode, and FIG. 8B illustrates the driving of first and second pixels in accordance with a sensing period of the driving waveform shown in FIG. 8A. A method for sensing the voltage of the OLED included in the second pixel, that is, the driving characteristic value of the second pixel in accordance with the second OLED sensing mode of the second sensing mode will be described with reference to FIGS. 8A and 8B.

First, as in the first OLED sensing mode of the first sensing mode, the second OLED sensing mode of the second sensing mode may include an addressing period (T1), a pre-charging period (T2), and a sensing period (T3). Except that the aforementioned second scan pulse (SP2) is supplied to the first scan line (SL1) and the aforementioned first scan pulse (SP1) is supplied to the second scan line (SL2), the remaining driving waveforms of the second OLED sensing mode are the same as those of the first OLED sensing mode.

For the sensing period (T3) of the second OLED sensing mode, the voltage charged in the capacitor (Cst) of each of the first and second pixels (P1, P2) is smaller than the threshold voltage of the driving transistor (Tdr) of the corresponding driving transistor (Tdr), whereby the driving transistor (Tdr) of each of the first and second pixels (P1, P2) is not driven. Also, as the second switching transistor (Tsw2) of the first pixel (P1) is turned-off, the OLED of the first pixel (P1) does not emit light so that the current does not flow in the first pixel (P1).

Meanwhile, as the first switch (SW1) is turned-off, the current flows from the reference line (RLk) to the second driving power line (PL2) through the first switching transistor (Tsw1) of the second pixel (P2) and the OLED due to the discharge of reference voltage (Vref) pre-charged in the sensing channel capacitor (Csch, see FIG. 4) and parasitic capacitor (Cline) connected with the reference line (RLk), whereby the voltage of the reference line (RLk) is reduced from the pre-charged reference voltage (Vref).

Accordingly, the sensing part 320 of the source driver 300 generates sensing data (Sdata) by sensing the second pixel voltage corresponding to the voltage ($V_{OLED}$) between anode and cathode electrodes of the OLED of the second pixel (P2) through the reference line (RLk) at a specific time point (t) after the first switch (SW1) is turned-off, and then provides the generated sensing data (Sdata) to the timing controller 400. The sensing data (Sdata) corresponding to the second pixel voltage of the second pixel (P2), which is sensed for the second OLED sensing mode of the second sensing mode, is provided to the timing controller 400.

The timing controller 400 compensates for the data by detecting the characteristic variation (or deviation of degradation) in accordance with the voltage of organic light emitting diode (OLED) for each pixel based on the sensing data (Sdata) for each pixel provided from the sensing part 320 of the source driver 300 for the respective OLED sensing modes of the first and second sensing modes. For example, the timing controller 400 calculates the sensing voltage for each pixel in accordance with the sensing data (Sdata) for each pixel, calculates the threshold voltage (or anode voltage) of organic light emitting diode (OLED) for each pixel based on the sensing voltage for each pixel, calculates offset data for each pixel so as to compensate for the threshold voltage variation of organic light emitting diode (OLED) for each pixel, and stores the calculated data in a Look-up Table of memory 410.

Figure 9:
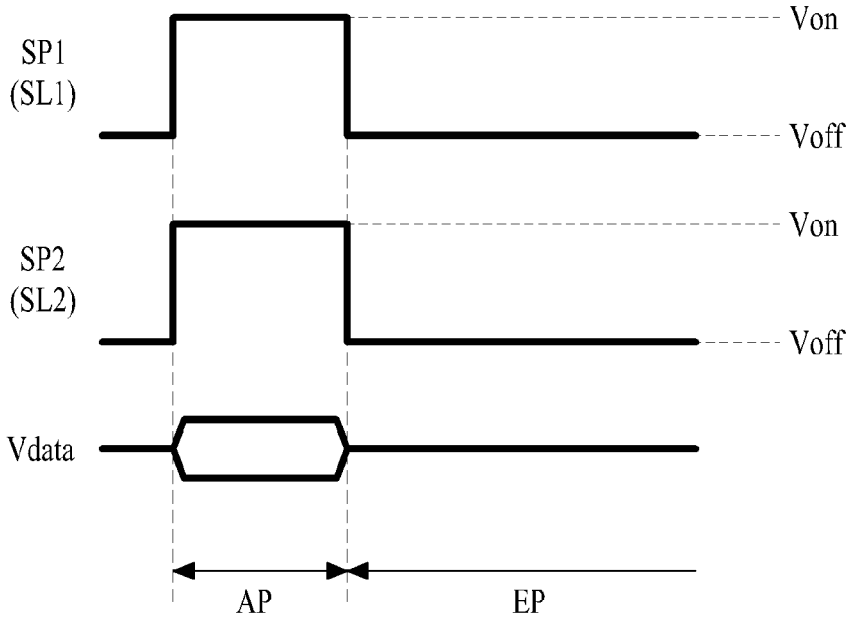
FIG. 9 is a waveform diagram showing a driving waveform of first and second pixels in accordance with a display mode in the organic light emitting display device according to the embodiment of the present invention.

Next, FIG. 9 is a waveform diagram showing a driving waveform of first and second pixels in accordance with the display mode. An operation of the first and second pixels in accordance with the display mode will be described with reference to FIG. 9 in connection with FIG. 3.

First, the display mode may include an addressing period (AP) and a light emitting period (EP). For the display mode, the low-potential voltage (EVss) selected by the voltage selector 500 is supplied to the second driving power line (PL2). For the addressing period (AP), the reference voltage (Vref) is supplied to the reference line (RLk) as the first switch (SW1) is turned-on by the first switch on/off signal (SS1) of the switch-on voltage (Von), and the reference line (RLk) is disconnected from the sensing part 320 as the second switch (SW2) is turned-off by the second switch on/off signal (SS2) of the switch-off voltage (Voff).

Also, all the first and second switching transistors (Tsw1, Tsw2) of the first and second pixels (P1, P2) are turned-on by the first and second scan pulses (SP1, SP2) of the gate-on voltage (Von) supplied from the scan driver 200 to the first and second scan lines (SL1, SL2). In synchronization with the above, the data voltages (Vdata) for displaying images are respectively supplied from the source driver 300 to the first and second data lines (DLj, DLj+1).

Thus, the data voltage (Vdata) and the reference voltage (Vref) are respectively supplied to the first and second nodes (n1, n2) of the first and second pixels (P1, P2), whereby the differential voltage (Vdata-Vref) between the data voltage (Vdata) and the reference voltage (Vref) is charged in the capacitor (Cst) of the respective pixels (P1, P2). For the addressing period (T1), the organic light emitting diodes (OLED) of the first and second pixels (P1, P2) do not emit light due to the reference voltage (Vref) supplied to the second node (n2) through the second switching transistor (Tsw2) being turned-on. Also, the data voltage (Vdata)

comprises the compensation voltage for compensating the driving variation for each pixel based on the sensing data (Sdata) for each pixel sensed by the sensing mode.

For the light emitting period (EP), all the first and second switching transistors (Tsw1, Tsw2) of the first and second pixels (P1, P2) are turned-off by the first and second pulses (SP1, SP2) of the gate-off voltage (Voff) supplied from the scan driver 200 to the first and second scan lines (SL1, SL2). Thus, the respective driving transistors (Tdr) of the first and second pixels (P1, P2) are driven by the voltage charged in the capacitors (Cst) of the first and second pixels (P1, P2), whereby the organic light emitting diodes (OLED) of the first and second pixels (P1, P2) emit lights by the current flowing in the driving transistors (Tdr).

Figure 10:
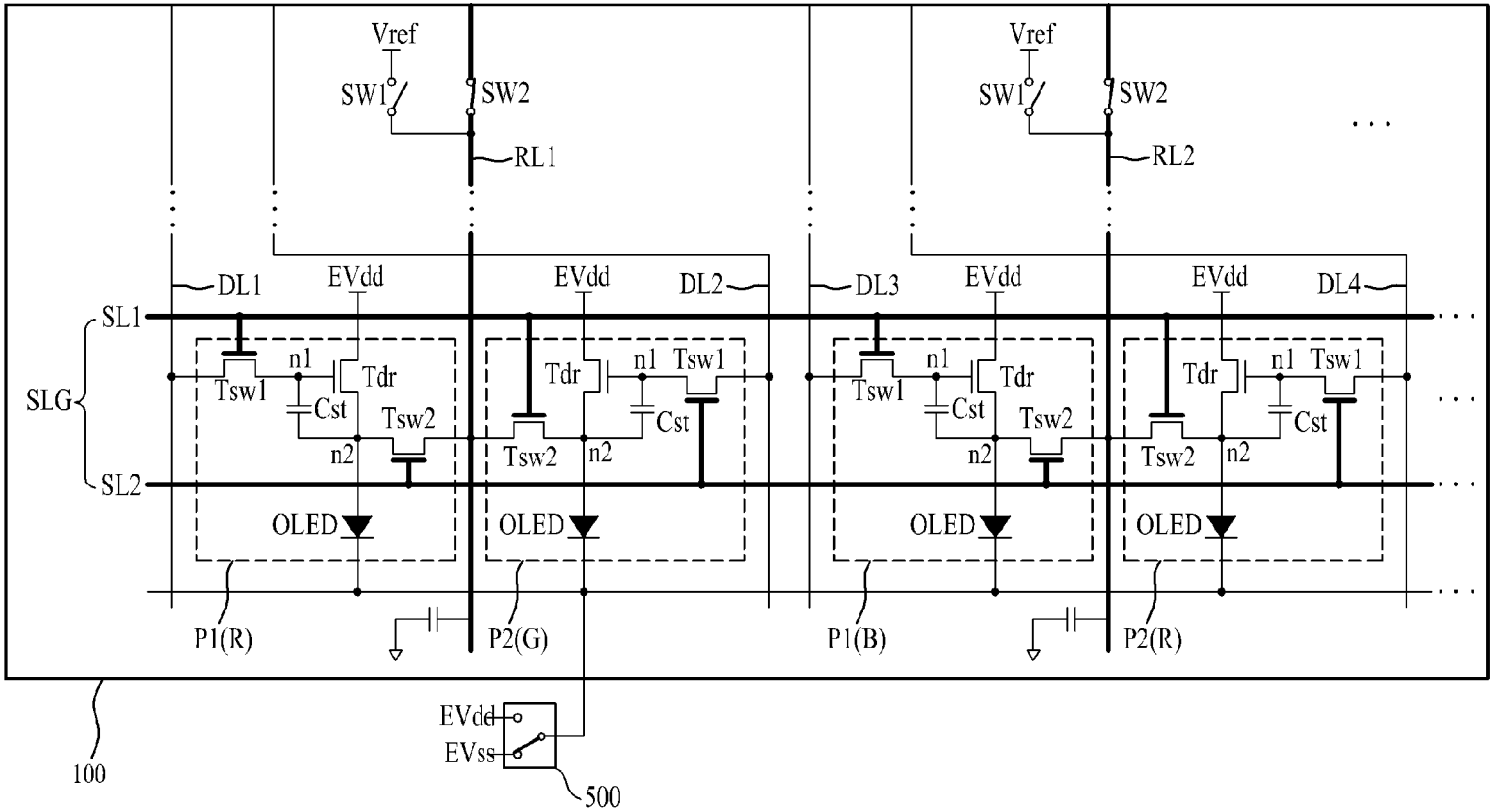
FIG. 10 illustrates a pixel arrangement structure of a display panel in the organic light emitting display device according to the embodiment of the present invention.

FIG. 10 illustrates a pixel arrangement structure of the display panel in the organic light emitting display device according to the embodiment of the present invention. As shown in FIG. 10, the display panel 100 includes the first pixel column of the first pixel (P1) and the second pixel column of the second pixel (P2) which use one reference line (RL) in common.

For the first pixel (P1) of the first pixel column, the first switching transistor (Tsw1) is connected with the first scan line (SL1), and the second switching transistor (Tsw2) is connected with the second scan line (SL2). For the second pixel (P2) of the second pixel column, the first switching transistor (Tsw1) is connected with the second scan line (SL2), and the second switching transistor (Tsw2) is connected with the first scan line (SL1). The driving characteristic values of the first and second pixels (P1, P2) are divided and sensed by the aforementioned first and second sensing modes through the scan pulses (SP1, SP2) supplied to the first and second scan lines (SL1, SL2).

The display panel 100 includes the first and second pixel columns which are repetitively arranged thereon. Along the length direction of the scan line (SL), unit pixels are repetitively arranged, wherein each unit pixel includes red (R), green (G) and blue (B) pixels. In the display panel 100 including the above pixel arrangement structure, the first half of the red (R), green (G) and blue (B) pixels formed in one horizontal line can be sensed by the first sensing mode, and the second half of the red (R), green (G) and blue (B) pixels can be sensed by the second sensing mode, but not necessarily. The pixels to be sensed by each of the first and second sensing modes may depend on the pixel arrangement structure.

Further, the display panel 100 may include unit pixels repetitively arranged, wherein each unit pixel includes white (W), red (R), green (G) and blue (B) pixels. In this instance, all the white (W) and green (G) pixels formed in one horizontal line can be sensed by the first sensing mode, and all the red (R) and blue (B) pixels can be sensed by the second sensing mode, but not necessarily. The pixels to be sensed by each of the first and second sensing modes can depend on the pixel arrangement structure.

Figure 11:
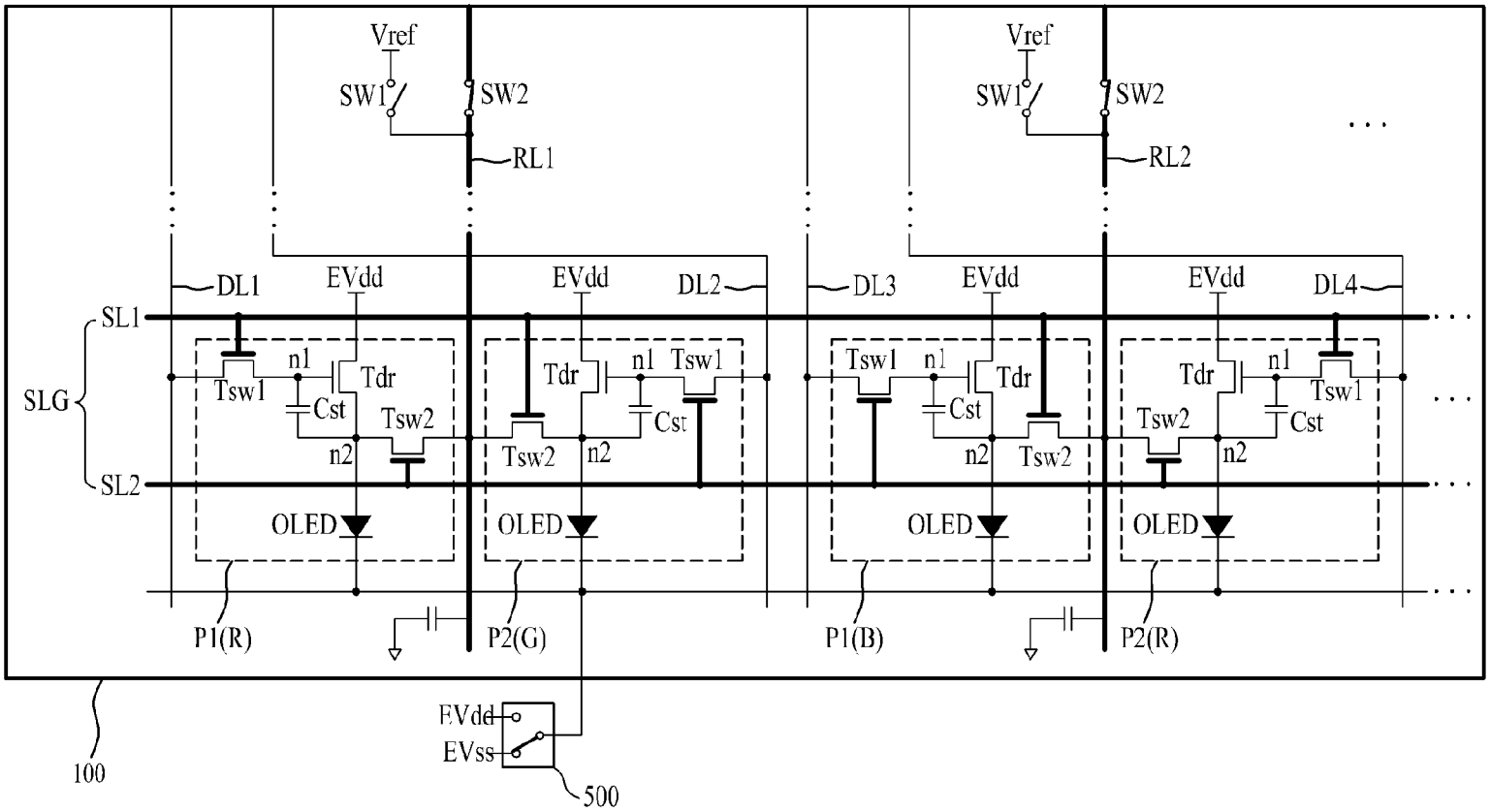
FIG. 11 illustrates a pixel arrangement structure of a display panel in the organic light emitting display device according to another embodiment of the present invention.

FIG. 11 illustrates a pixel arrangement structure of the display panel in the organic light emitting display device according to another embodiment of the present invention. As shown in FIG. 11, the display panel 100 includes the first pixel column of the first pixel (P1) and the second pixel column of the second pixel (P2) which use one reference line (RL) in common. In this instance, two of the first pixel (P1) being adjacent to each other in the length direction of the scan line (SL) have the different connection structures, and two of the second pixel (P2) being adjacent to each other in the length direction of the scan line (SL) have the different connection structures.

That is, in case of any one of the adjacent two of first pixel (P1), the first switching transistor (Tsw1) is connected with the first scan line (SL1), and the second switching transistor (Tsw2) is connected with the second scan line (SL2). Meanwhile, in case of the remaining one of the adjacent two of first pixel (P1), the first switching transistor (Tsw1) is connected with the second scan line (SL2), and the second switching transistor (Tsw2) is connected with the first scan line (SL1). Similarly, in case of any one of the adjacent two of second pixel (P2), the first switching transistor (Tsw1) is connected with the second scan line (SL2), and the second switching transistor (Tsw2) is connected with the first scan line (SL1). Meanwhile, in case of the remaining one of the adjacent two of second pixel (P2), the first switching transistor (Tsw1) is connected with the first scan line (SL1), and the second switching transistor (Tsw2) is connected with the second scan line (SL2).

The driving characteristic values of the first and second pixels (P1, P2) are divided and sensed by the aforementioned first and second sensing modes through the scan pulses (SP1, SP2) supplied to the first and second scan lines (SL1, SL2).

On the display panel 100, there are the first and second pixel columns which are repetitively arranged thereon. Along the length direction of the scan line (SL), there are unit pixels repetitively arranged, wherein each unit pixel includes red (R), green (G) and blue (B) pixels. In the display panel 100 including the above pixel arrangement structure, all the red (R) pixels and the first half of green (G) pixels formed in one horizontal line are sensed by the first sensing mode, and the second half of green (G) pixels and all the blue (B) pixels formed in one horizontal lines are sensed by the second sensing mode, but not necessarily. The pixels to be sensed by each of the first and second sensing modes may depend on the pixel arrangement structure.

On the display panel 100, there may be unit pixels repetitively arranged, wherein each unit pixel may include white, red (R), green (G) and blue (B) pixels. In this instance, all the white (W) and blue (B) pixels formed in one horizontal line may be sensed by the first sensing mode, and all the red (R) and green (G) pixels may be sensed by the second sensing mode, but not necessarily. The pixels to be sensed by each of the first and second sensing modes may depend on the pixel arrangement structure.

According to an embodiment of the present invention, the first and second pixels (P1, P2), that is, the two pixels being adjacent to each other in the length direction of the scan line are connected with one reference line (RL) in common so that the number of reference lines (RL) is reduced by half, and thus the number of reference lines (RL) formed on the display panel 100 is the half of the number of data lines (DL).

Also, in comparison to the number of data lines (DL), the number of sensing channels prepared in the source driver 300 connected in one-to-one correspondence with the reference lines (RL) formed on the display panel 100 is reduced by half so that it is possible to reduce the number of channels of the source driver 300, which enables to facilitate a design of the source driver 300.

According to the structure of the present invention in which the neighboring two pixels of the first and second pixels (P1, P2) uses one reference line (RL) in common, the driving characteristic values of the first and second pixels (P1, P2) can be sensed through the first and second sensing modes, and improved picture quality may be achieved by compensating the driving variation for each pixel in the method of correcting the data for the corresponding pixel based on the sensing data for each pixel, to thereby increase a lifespan of the organic light emitting display device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device comprising:

a display panel including first and second scan lines in a first direction, first and second data lines in a second direction, a first pixel connected with the first data line and the first and second scan lines, a second pixel connected with the second data line and the first and second scan lines, and a first reference line connected in common with the first and second pixels, wherein the first and second pixels are adjacent each other in the first direction;

a source driver configured to operate first and second sensing modes for sensing driving characteristic values of the first and second pixels through the first reference line; and a scan driver configured to drive the first and second scan lines so as to drive the first pixel for the first sensing mode or the second pixel for the second sensing mode, wherein the scan driver is further configured to drive only the first pixel by supplying a first scan pulse to the first scan line and supplying a second scan pulse to the second scan line for the first sensing mode, and drive only the second pixel by supplying the second scan pulse to the first scan line and supplying the first scan pulse to the second scan line for the second sensing mode.

2. The organic light emitting display device according to claim 1, wherein the first and second pixels include:

an organic light emitting diode;

a driving transistor configured to control a current flowing in the organic light emitting diode;

a first switching transistor configured to supply a data voltage, supplied to the corresponding data line, to a first node connected with a gate electrode of the driving transistor;

a second switching transistor configured to supply a reference signal, supplied to the first reference line, to a second node connected between the organic light emitting diode and the driving transistor; and a capacitor connected between the first and second nodes, wherein the first switching transistor of the first pixel is connected with the first scan line, and the second switching transistor of the first pixel is connected with the second scan line, and wherein the first switching transistor of the second pixel is connected with the second scan line, and the second switching transistor of the second pixel is connected with the first scan line.

3. The organic light emitting display device according to claim 2, wherein the source driver includes:

a data voltage supplier configured to supply the data voltage to each of the first and second data lines; and a sensing part configured to sense the driving characteristic value of the first pixel through the first reference line for the first sensing mode, and sense the driving characteristic value of the second pixel through the first reference line for the second sensing mode.

4. The organic light emitting display device according to claim 3, further comprising:

a first switching element configured to pre-charge the first reference line with the reference voltage for a pre-charging period of the first and second sensing modes; and a second switching element configured to connect the first reference line with the sensing part for a sensing period of the first and second sensing modes, wherein the first and second switching elements are formed in the display panel or source driver.

5. The organic light emitting display device according to claim 4, wherein the display panel further includes a voltage selector configured to selectively supply a high-potential voltage or low-potential voltage to a cathode electrode of the organic light emitting diode included in each of the first and second pixels.

6. The organic light emitting display device according to claim 5, wherein the driving characteristic value of each of the first and second pixels corresponds to a current flowing in the corresponding driving transistor, and wherein the sensing part of the source driver is further configured to sense the current flowing in the driving transistor of the first pixel through the first reference line in accordance with the driving of the first and second scan lines for the sensing period of the first sensing mode, and sense the current flowing in the driving transistor of the second pixel through the reference line in accordance with the driving of the first and second scan lines for the sensing period of the second sensing mode.

7. The organic light emitting display device according to claim 6, wherein the voltage selector is further configured to supply the high-potential voltage to the cathode electrode of the organic light emitting diode included in the first and second pixels for the first and second sensing modes.

8. The organic light emitting display device according to claim 5, wherein the driving characteristic value of each of the first and second pixels corresponds to a current flowing in the corresponding organic light emitting diode, and wherein the sensing part of the source driver is further configured to sense a voltage of the organic light emitting diode included in the first pixel through the first reference line in accordance with the driving of the first and second scan lines for the sensing period of the first sensing mode, and sense a voltage of the organic light emitting diode included in the second pixel through the first reference line in accordance with the driving of the first and second scan lines for the sensing period of the second sensing mode.

9. The organic light emitting display device according to claim 8, wherein the voltage selector is further configured to supply the low-potential voltage to the cathode electrode of the organic light emitting diode included in the first and second pixels for the first and second sensing modes.

10. The organic light emitting display device according to claim 1, wherein the first sensing mode includes a first TFT sensing mode for sensing the driving characteristic value of a driving transistor of the first pixel, and a first organic light emitting diode sensing mode for sensing the driving characteristic value of an organic light emitting diode of the first pixel, and wherein the second sensing mode includes a second TFT sensing mode for sensing the driving characteristic value of a driving transistor of the second pixel, and a second organic light emitting diode sensing mode for sensing the driving characteristic value of an organic light emitting diode of the second pixel.

11. The organic light emitting display device according to claim 10, wherein the display panel further includes:

a voltage selector configured to selectively supply a high-potential voltage or low-potential voltage to a cathode electrode of the organic light emitting diode included in each of the first and second pixels.

12. The organic light emitting display device according to claim 11, wherein in the first and second TFT sensing modes, the voltage selector supplies the low-potential voltage to the cathode electrode of the organic light emitting diode.

13. The organic light emitting display device according to claim 11, wherein in the first and second organic light emitting diode sensing modes, the voltage selector supplies the high-potential voltage to the cathode electrode of the organic light emitting diode.

14. The organic light emitting display device according to claim 10, wherein in the first TFT sensing mode, the driving transistor of the first pixel is driven and the driving transistor of the second pixel is not driven.

15. The organic light emitting display device according to claim 14, wherein in the second TFT sensing mode, the driving transistor of the second pixel is driven and the driving transistor of the first pixel is not driven.

16. The organic light emitting display device according to claim 15, wherein the organic light emitting diodes of the first and second pixels are not driven in the first and second TFT sensing modes.

17. The organic light emitting display device according to claim 10, wherein in the first organic light emitting diode sensing mode, the organic light emitting diode of the first pixel is driven and the organic light emitting diode of the second pixel is not driven.

18. The organic light emitting display device according to claim 17, wherein in the second organic light emitting diode sensing mode, the organic light emitting diode of the second pixel is driven and the organic light emitting diode of the first pixel is not driven.

19. The organic light emitting display device according to claim 18, wherein the driving transistors of the first and second pixels are not driven in the first and second organic light emitting diode sensing modes.

20. The organic light emitting display device according to claim 1, wherein the display panel further includes:

third and fourth data lines in the second direction.

21. The organic light emitting display device according to claim 20, wherein the display panel further includes:

a second reference line in parallel with the first reference line in the second direction, the second reference line is connected to the third and fourth data lines in the second direction.

* * * * *